US007880687B2

(12) United States Patent
Kondo et al.

(10) Patent No.: US 7,880,687 B2
(45) Date of Patent: Feb. 1, 2011

(54) DISPLAY DEVICE, DISPLAY METHOD, PROGRAM, RECORDING MEDIUM, AND COMPOSITE IMAGE DISPLAY APPARATUS

(75) Inventors: Tetsujiro Kondo, Tokyo (JP); Tsuyoshi Tanaka, Kanagawa (JP); Yoshinori Watanabe, Kanagawa (JP)

(73) Assignee: Sony Corporation, Tokyo (JP)

( * ) Notice: Subject to any disclaimer, the term of this patent is extended or adjusted under 35 U.S.C. 154(b) by 905 days.

(21) Appl. No.: 11/400,208

(22) Filed: Apr. 10, 2006

(65) Prior Publication Data

US 2006/0242871 A1 Nov. 2, 2006

(30) Foreign Application Priority Data

Apr. 28, 2005 (JP) ..... 2005-132787

(51) Int. Cl.
*G09G 5/00* (2006.01)

(52) U.S. Cl. ..... 345/1.1; 345/1.3

(58) Field of Classification Search ..... 345/1.1–1.3
See application file for complete search history.

(56) References Cited

U.S. PATENT DOCUMENTS 5,128,662 A * 7/1992 Failla ..... 345/1.3
6,415,224 B1 * 7/2002 Wako et al. ..... 701/208
2005/0134525 A1 * 6/2005 Tanghe et al. ..... 345/1.1
2006/0109197 A1 * 5/2006 Kuwabara et al. ..... 345/1.1

FOREIGN PATENT DOCUMENTS

JP 2003-195843 7/2003

* cited by examiner

*Primary Examiner*—Amr Awad
*Assistant Examiner*—Jonathan Boyd
(74) *Attorney, Agent, or Firm*—Oblon, Spivak, McClelland, Maier & Neustadt, L.L.P.

(57) ABSTRACT

A display device for a composite image display apparatus includes: a self-state acquiring unit configured to acquire information indicating a mounting position of a self device in the composite image display apparatus and a mounting state of the self device; an other-device's-state acquiring unit configured to acquire information indicating a mounting position of each of other display devices in the composite image display apparatus and a state of each of the other display devices; and a display controlling unit configured to control display of an image to be displayed on a display section of the self device, on the basis of the information acquired by each of the self-state acquiring unit and the other-device's-state acquiring unit.

18 Claims, 28 Drawing Sheets

FIG. 12

| ID | A1 | A2 | A3 | B1 | B2 | B3 | C1 | C2 | C3 | ··· | n |
|---|---|---|---|---|---|---|---|---|---|---|---|
| STATE | FRONT | NONE | FRONT | BACK | BACK | BACK | NONE | FRONT | FRONT | ··· | NONE |
| UPDATE TIME | 1:00 | 0:00 | 1:00 | 1:00 | 1:00 | 1:00 | 0:00 | 1:00 | 1:00 | ··· | 0:00 |

DISPLAY DEVICE, DISPLAY METHOD, PROGRAM, RECORDING MEDIUM, AND COMPOSITE IMAGE DISPLAY APPARATUS

CROSS REFERENCES TO RELATED APPLICATIONS

The present invention contains subject matter related to Japanese Patent Application JP 2005-132787 filed in the Japanese Patent Office on Apr. 28, 2005, the entire contents of which are incorporated herein by reference.

BACKGROUND OF THE INVENTION

1. Field of the Invention

The present invention relates to a display device, a display method, a program, a recording medium, and a composite image display apparatus. More specifically, the present invention relates to a display device, a display method, a program, a recording medium, and a composite image display apparatus, which can provide improved convenience for the user when used in applications where a number of display devices such as television receivers are connected together for use.

2. Description of the Related Art

In a television receiver, upon reception of a television broadcast signal, an image as a television broadcast program is displayed and sound accompanying the image is output. In the past, a television receiver is assumed to be used alone. Therefore, when the user purchases a new television receiver, the television receiver the user previously owned becomes unnecessary and often discarded even though it is still usable.

Accordingly, if, when connecting a number of television receivers together, it is possible to achieve greater functionality than can be achieved when each television receiver is used alone, it is possible to prevent discarding of usable television receivers, thus enabling effective utilization of resources.

In view of this, there has been proposed a technique that makes it possible to achieve greater functionality when a number of display devices such as television receivers are connected together for use than in the case when each of these devices is used alone (see, for example, Japanese Unexamined Patent Application Publication No. 2003-195843).

According to the technique disclosed in Japanese Unexamined Patent Application Publication No. 2003-195843, an image can be displayed by a display device assembly including nine display devices, for example.

SUMMARY OF THE INVENTION

However, there are many other examples of application for the image display method to be employed in the case where a number of display devices such as television receivers are connected together for use. For instance, while in the related art an assembly of a plurality of (for example, nine) display devices can be used to operate as a single display device, it is more convenient if the assembly of the plurality of (for example, nine) display devices can be further split into a plurality of (for example, three) assemblies each including a plurality of (for example, three) display devices, and different images can be separately displayed on the individual assemblies.

Further, greater convenience can be achieved if the display devices can be watched not only from the front side by making them face the front but also from the back side by making some of the display devices face the back.

Therefore, it is desirable to make it possible to improve the convenience for the user in cases where a number of display devices such as television receivers are connected together for use.

According to an embodiment of the present invention, there is provided a display device for a composite image display apparatus that displays an image by a plurality of display devices that are detachably mounted to a plurality of mounting positions, including: self-state acquiring means for acquiring information indicating a mounting position of a self device in the composite image display apparatus and a mounting state of the self device; other-device's-state acquiring means for acquiring information indicating a mounting position of each of other display devices in the composite image display apparatus and a state of each of the other display devices; and display controlling means for controlling display of an image to be displayed on a display section of the self device, on the basis of the information acquired by each of the self-state acquiring means and the other-device's-state acquiring means.

Further, according to an embodiment of the present invention, there is provided a display device for a composite image display apparatus that displays an image by a plurality of display devices that are detachably mounted to a plurality of mounting positions, including: a self-state acquiring unit configured to acquire information indicating a mounting position of a self device in the composite image display apparatus and a mounting state of the self device; an other-device's-state acquiring unit configured to acquire information indicating a mounting position of each of other display devices in the composite image display apparatus and a state of each of the other display devices; and a display controlling unit configured to control display of an image to be displayed on a display section of the self device, on the basis of the information acquired by each of the self-state acquiring unit and the other-device's-state acquiring unit.

It is possible to adopt a configuration in which the display section can be oriented to face one of two directions different from each other by 180° while being mounted on the composite image display apparatus.

It is possible to adopt a configuration in which the information indicating the mounting state acquired by the self-state acquiring means or the other-device's-state acquiring means is information indicating whether the self device or each of the other devices is currently mounted at a predetermined position, and an orientation of the display section.

It is possible to adopt a configuration in which on the basis of the information acquired by each of the self-state acquiring means and the other-device's-state acquiring means, the display device displays on the display section of the self device an image that is the same as images displayed on the other devices having display sections that are oriented in the same direction as the display section of the self device.

It is possible to adopt a configuration in which the display controlling means includes area/magnification selecting means for selecting an area of the image to be displayed by the self device, and a display magnification for an image corresponding to the area, on the basis of the mounting position of the self device and mounting positions of the other display devices having the display sections that are oriented in the same direction as the display section of the self device.

It is possible to adopt a configuration in which the image is a moving image, and the display controlling means includes still timing selecting means for selecting a timing for stilling the moving image on the basis of the mounting position of the self device and mounting positions of the other display devices having the display sections that are oriented in the same direction as the display section of the self device, and a preset event.

It is possible to adopt a configuration in which the event occurs each time a predetermined period of time elapses.

It is possible to adopt a configuration in which the event occurs when display of a specific preset image is detected.

It is possible to adopt a configuration in which the event occurs upon command from a user.

It is possible to adopt a configuration in which the display controlling means includes image kind selecting means for selecting, from among a plurality of kinds of images, an image to be displayed by the self device on the basis of the mounting position of the self device and mounting positions of the other display devices having the display sections that are oriented in the same direction as the display section of the self device.

It is possible to adopt a configuration in which the display controlling means includes image switching means for forcibly switching the image displayed on the display section on the basis of the mounting position of the self device and mounting positions of the other display devices having the display sections that are oriented in the same direction as the display section of the self device, and a signal transmitted from external equipment connected to the composite image display apparatus.

According to an embodiment of the present invention, there is provided a display method for a display device for a composite image display apparatus that displays an image by a plurality of display devices that are detachably mounted to a plurality of mounting positions, including: a self-state acquiring step of acquiring information indicating a mounting position of a self device in the composite image display apparatus and a mounting state of the self device; an other-device's-state acquiring step of acquiring information indicating a mounting position of each of other display devices in the composite image display apparatus and a state of each of the other display devices; and a display controlling step of controlling display of an image to be displayed on a display section of the self device, on the basis of the information acquired by each of the self-state acquiring step and the other-device's-state acquiring step.

According to an embodiment of the present invention, there is provided a program for causing display processing to be executed by a display device for a composite image display apparatus that displays an image by a plurality of display devices that are detachably mounted to a plurality of mounting positions, the program causing a computer to execute: a self-state acquisition controlling step of controlling acquisition of information indicating a mounting position of a self device in the composite image display apparatus and a mounting state of the self device; an other-device's-state acquisition controlling step of controlling acquisition of information indicating a mounting position of each of other display devices in the composite image display apparatus and a state of each of the other display devices; and a display controlling step of controlling display of an image to be displayed on a display section of the self device, on the basis of the information acquired by each of the self-state acquisition controlling step and the other-device's-state acquisition controlling step.

With the display device, the display method, and the program according to embodiments of the present invention, information indicating the mounting position of the self device in the composite image display apparatus and the mounting state of the self device is acquired, information indicating the mounting positions of the other display device in the composite image display apparatus and the mounting states of the other display devices is acquired, and, on the basis of the thus acquired information, the display of the image to be displayed on the display section of the self device is controlled.

BRIEF DESCRIPTION OF THE DRAWINGS

FIG. 12 is a diagram showing an example of an overall configuration table;

DESCRIPTION OF THE PREFERRED EMBODIMENTS

Figure 1:
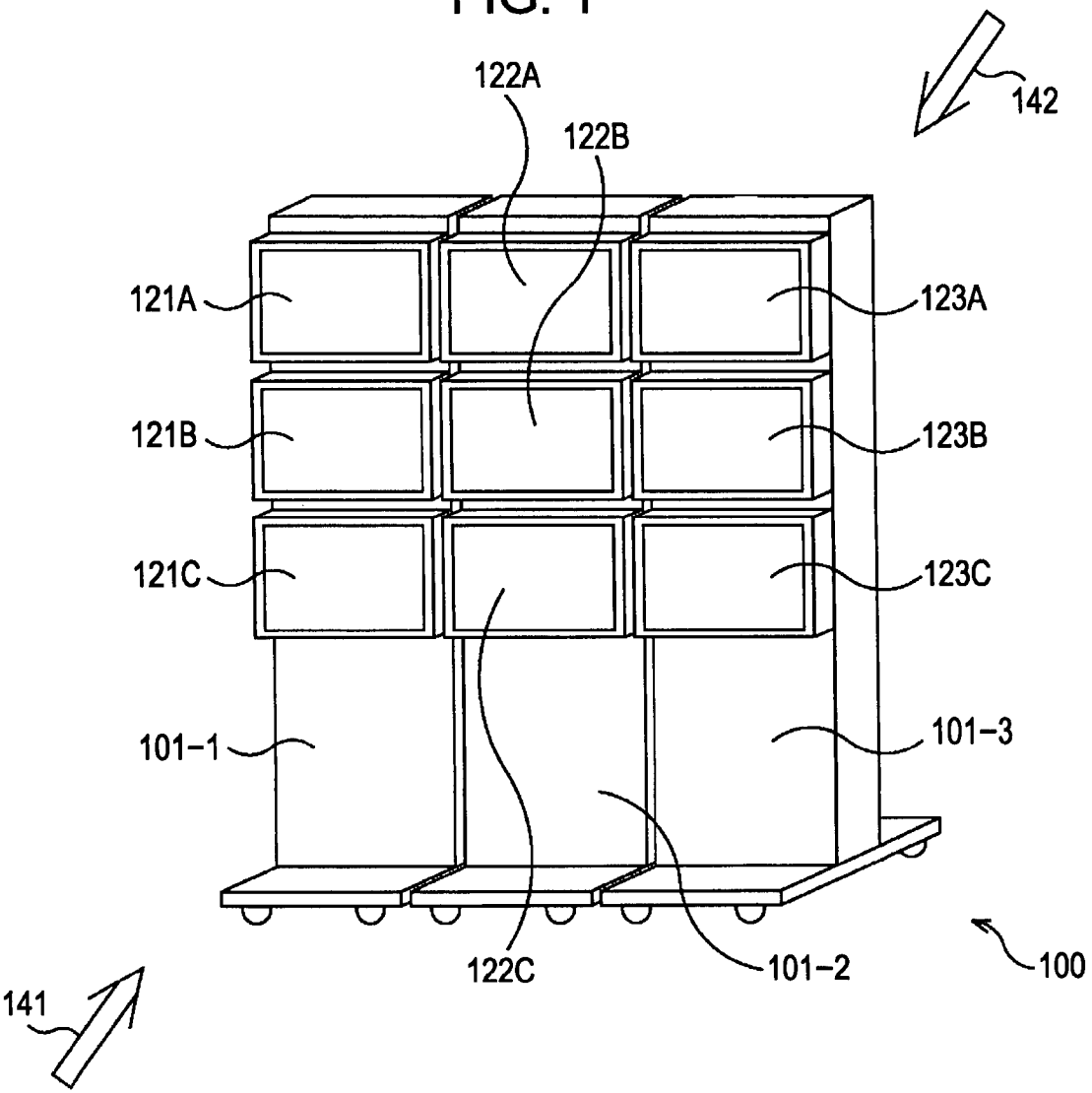
FIG. 1 is a view showing an example of the configuration of a scalable television system according to an embodiment of the present invention.

Before describing an embodiment of the present invention, the correspondence between the invention as described in this specification and an embodiment of the present invention is discussed below. This description is intended to assure that an embodiment(s) supporting the invention as described in this specification are described in this specification. Thus, even if an embodiment is described in the specification but not described herein as relating to a certain aspect of the present invention, that does not necessarily mean that the embodiment does not relate to that aspect of the invention. Conversely, even if an embodiment is described herein as relating to a certain aspect of the invention, that does not necessarily mean that the embodiment does not relate to other aspects of the invention.

Furthermore, this description should not be construed as restricting that all the aspects of the invention disclosed in the specification are described in the claims. That is, the description does not deny the existence of aspects of the present invention that are described in the specification but not claimed in this application, i.e., the existence of aspects of the present invention that in future may be claimed by a divisional application, or that may be additionally claimed through amendments.

According to an embodiment of the present invention, there is provided a display device for a composite image display apparatus (for example, a scalable television system 100 shown in FIG. 1) that displays an image by a plurality of display devices that are detachably mounted to a plurality of mounting positions, including: self-state acquiring means (for example, a central processing section 202 shown in FIG. 9 that executes the processing of step S121 shown in FIG. 11) for acquiring information indicating a mounting position of a self device in the composite image display apparatus and a mounting state of the self device; other-device's-state acquiring means (for example, the central processing section 202 shown in FIG. 9 that executes the processing of step S123 shown in FIG. 11) for acquiring information indicating a mounting position of each of other display devices in the composite image display apparatus and a state of each of the other display devices; and display controlling means (for example, an application processing section 205 shown in FIG. 9) for controlling display of an image to be displayed on a display section of the self device, on the basis of the information acquired by each of the self-state acquiring means and the other-device's-state acquiring means.

According to an embodiment of the present invention, in the display device, the display section can be oriented to face one of two directions (for example, the front and the back) different from each other by 180° while being mounted on the composite image display apparatus.

According to an embodiment of the present invention, in the display device, the display controlling means includes area/magnification selecting means (for example, a zoom processing section 221 shown in FIG. 9) for selecting an area of the image to be displayed by the self device, and a display magnification for an image corresponding to the area, on the basis of the mounting position of the self device and mounting positions of the other display devices having the display sections that are oriented in the same direction as the display section of the self device.

Figure 9:
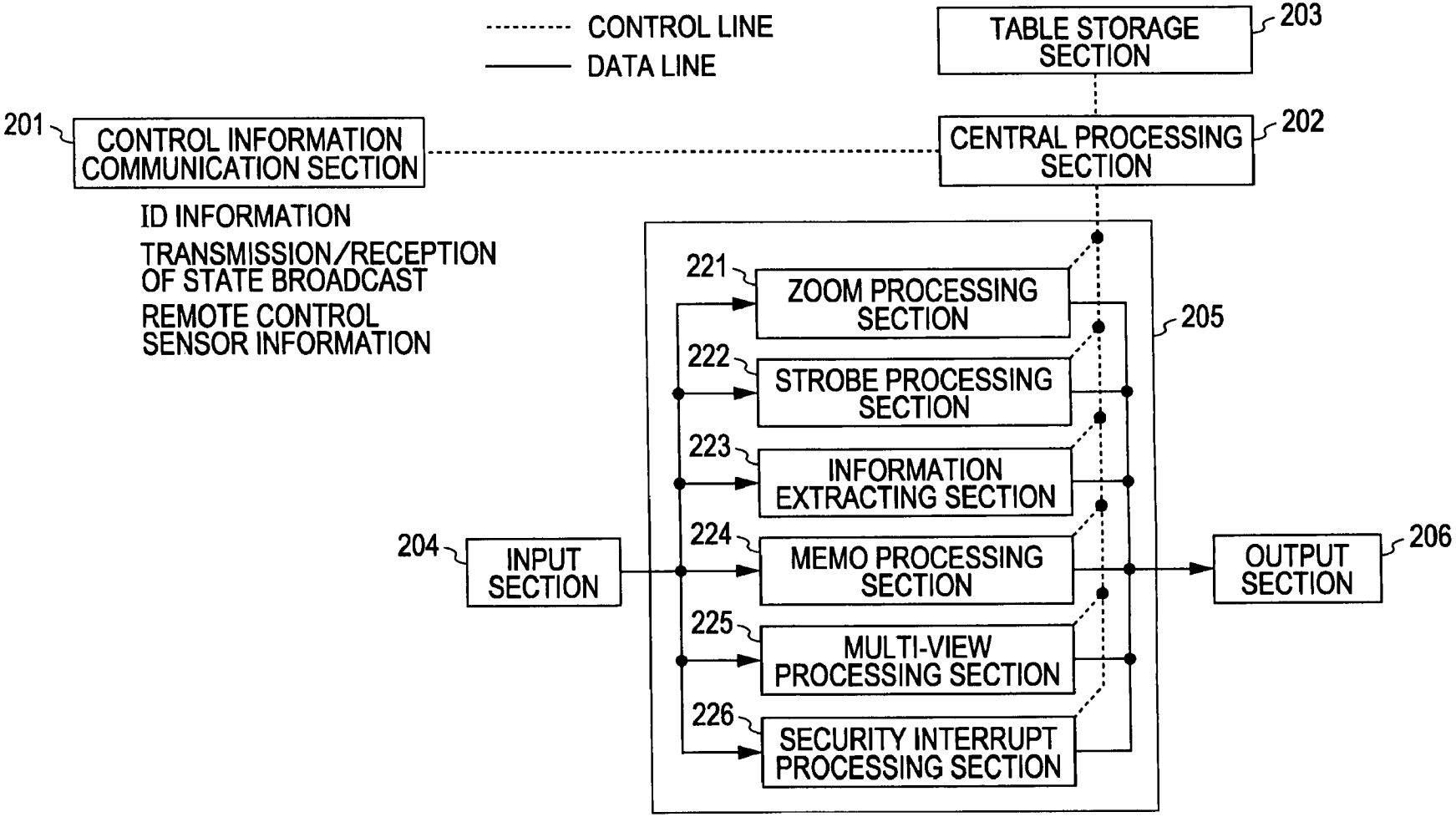
FIG. 9 is a block diagram showing an example of the internal configuration of a display device.

According to an embodiment of the present invention, in the display device, the image is a moving image, and the display controlling means includes still timing selecting means (for example, processing sections from a strobe processing section 222 to a memo processing section 224 shown in FIG. 9) for selecting a timing for stilling the moving image on the basis of the mounting position of the self device and mounting positions of the other display devices having the display sections that are oriented in the same direction as the display section of the self device, and a preset event.

According to an embodiment of the present invention, in the display device, the display controlling means includes image kind selecting means (for example, a multi-view processing section 225 shown in FIG. 9) for selecting, from among a plurality of kinds of images, an image to be displayed by the self device on the basis of the mounting position of the self device and mounting positions of the other display devices having the display sections that are oriented in the same direction as the display section of the self device.

According to an embodiment of the present invention, in the display device, the display controlling means includes image switching means (for example, a security interrupt processing section 226 shown in FIG. 9) for forcibly switching the image displayed on the display section on the basis of the mounting position of the self device and mounting positions of the other display devices having the display sections that are oriented in the same direction as the display section of the self device, and a signal transmitted from external equipment (for example, an interphone) connected to the composite image display apparatus.

Figure 10:
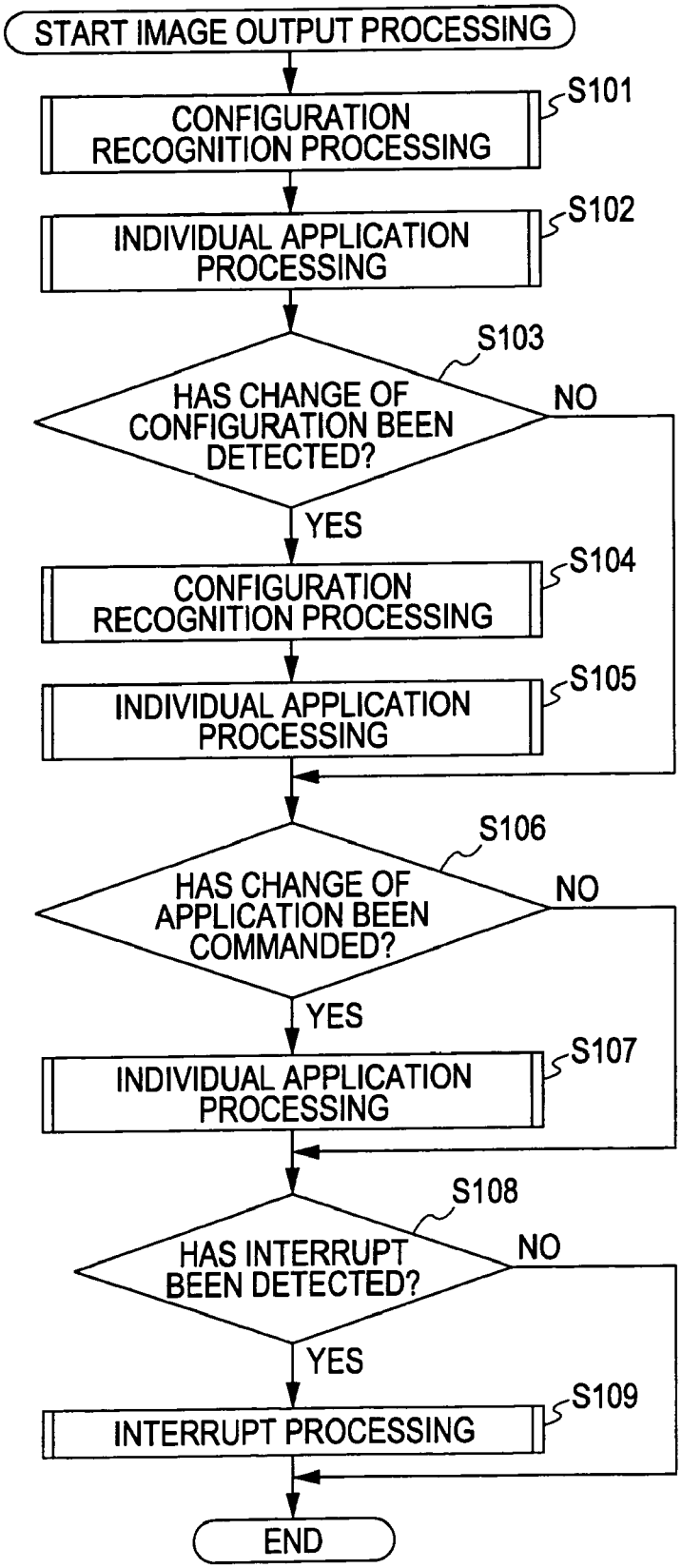
FIG. 10 is a flowchart illustrating an example of image output processing.

According to an embodiment of the present invention, there is provided a display method for a display device for a composite image display apparatus (for example, the scalable television system 100 shown in FIG. 1) that displays an image by a plurality of display devices that are detachably mounted to a plurality of mounting positions, including: a self-state acquiring step (for example, the processing of step S121 shown in FIG. 11) of acquiring information indicating a mounting position of a self device in the composite image display apparatus and a mounting state of the self device; an other-device's-state acquiring step (for example, the processing of step S123 shown in FIG. 11) of acquiring information indicating a mounting position of each of other display devices in the composite image display apparatus and a state of each of the other display devices; and a display controlling step (for example, the processing of step S102, S105, S107, or S109 shown in FIG. 10) of controlling display of an image to be displayed on a display section of the self device, on the basis of the information acquired by each of the self-state acquiring step and the other-device's-state acquiring step.

According to an embodiment of the present invention, there is provided a program for causing display processing to be executed by a display device for a composite image display apparatus (for example, the scalable television system 100 shown in FIG. 1) that displays an image by a plurality of display devices that are detachably mounted to a plurality of mounting positions, the program causing a computer to execute: a self-state acquisition controlling step (for example, the processing of step S121 shown in FIG. 11) of controlling acquisition of information indicating a mounting position of a self device in the composite image display apparatus and a mounting state of the self device; an other-device's-state acquisition controlling step (for example, the processing of step S123 shown in FIG. 11) of controlling acquisition of information indicating a mounting position of each of other display devices in the composite image display apparatus and a state of each of the other display devices; and a display controlling step (for example, the processing of step S102, S105, S107, or S109 shown in FIG. 10) of controlling display of an image to be displayed on a display section of the self device, on the basis of the information acquired by each of the self-state acquisition controlling step and the other-device's-state acquisition controlling step.

Now, an embodiment of the present invention will be described with reference to the drawings.

FIG. 1 is a view showing an example of the configuration of a scalable television system 100 according to an embodiment of the present invention. The scalable television system 100 includes a plurality of interconnected units allowing mounting of a plurality of display devices at a plurality of different mounting positions. By increasing or decreasing the number of units to be connected, the number of display devices can be freely increased or decreased.

In the example shown in FIG. 1, the scalable television system 100 includes three units, units 101-1 to 101-3. In each of the units 101-1 to 101-3, a plurality of (in this example, three) display devices such as television receivers are mounted in a row in the vertical direction of the drawing. Display devices 121A to 121C, display devices 122A to 122C, and display devices 123A to 123C are mounted in a row in the vertical direction of the drawing to the units 101-1, 101-2, and 101-3, respectively. Further, the units 101-1 to 101-3 are connected in a row in the horizontal direction of the drawing, thereby forming the scalable television system 100 having nine display devices.

The nine display devices 121A to 123C have the same configuration and function. For example, upon receiving a television broadcast signal, a signal of a monitor connected to an interphone, or the like, each of the display devices 121A to 123C causes an image to be displayed on a display section including LCDs (Liquid Crystal Displays) or the like, or causes sound to be output from a sound output section including a speaker or the like. In the scalable television system 100, in addition to making the individual display devices function independently, it is possible to make an assembly of nine display devices function as if it is a single display device. Further, in the scalable television system 100, it is also possible to divide the nine display devices into three assemblies each including, for example, three display devices, and make the individual assembles display different images separately.

As will be described later with reference to FIG. 2, in the scalable television system 100, each of the display devices 121A to 123C is adapted to be rotatable by 180°, thus allowing the user to view and listen to an image and sound from the front side of the scalable television system 100 as indicated by an arrow 141, and from the back side of the scalable television system 100 as indicated by an arrow 142.

For example, the scalable television system 100 can be placed between the living room and the kitchen so that the front-side surface thereof faces the living room and displays a sport broadcasting program or the like while the back-side surface thereof faces the kitchen and displays the image of a cooking program.

Figure 2A:
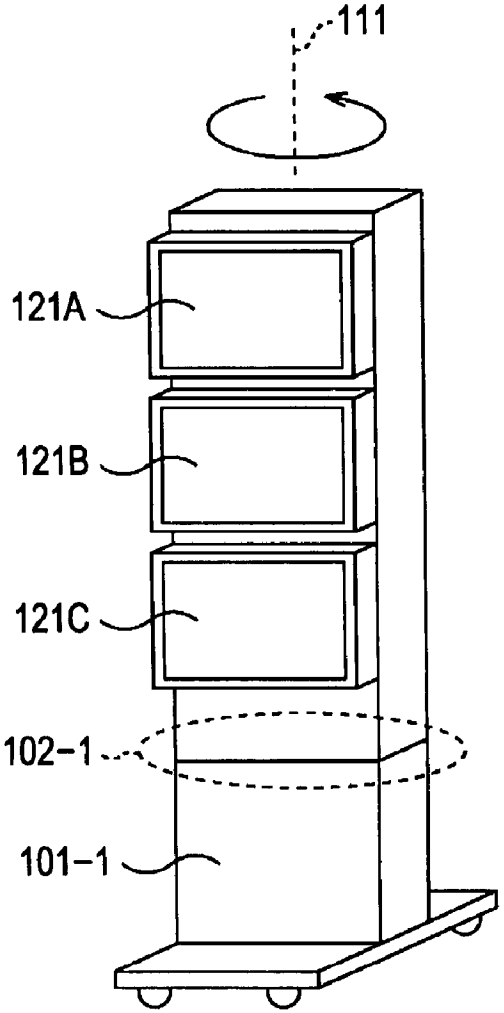
FIGS. 2A to 2C are views each showing an example of the configuration of a unit shown in FIG. 1.
Figure 2B:
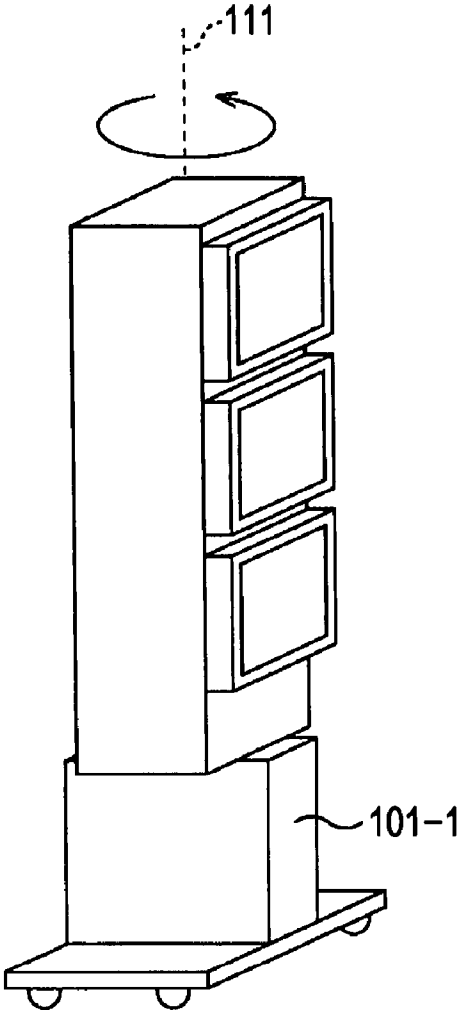
Figure 2C:
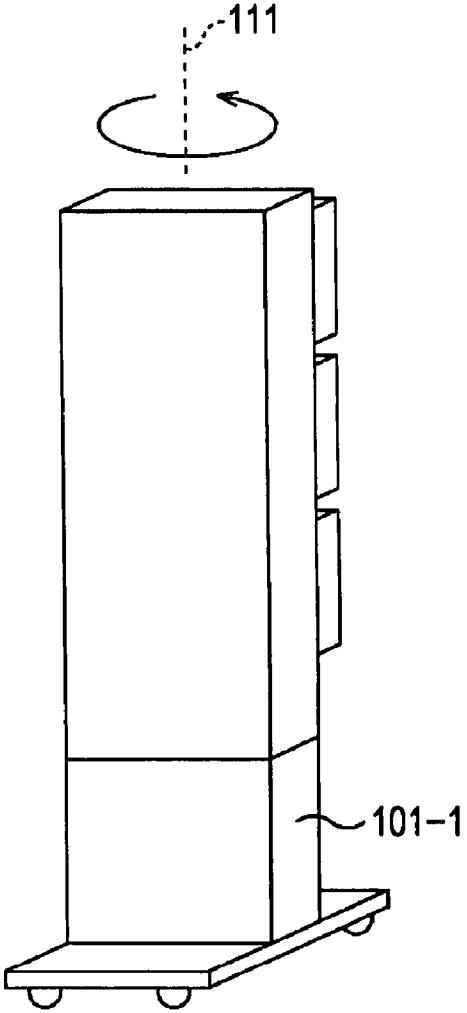

FIGS. 2A to 2C are views illustrating how the display devices 121A to 123C described above rotate. These figures illustrate a case where the respective display devices 121A to 123C are adapted to rotate on a unit-by-unit basis. Here, the unit 101-1 is shown as an example.

As shown in FIG. 2A, the unit 101-1 is adapted to be rotatable by 180° at the position of a dashed-line circle 102-1 about an axis 111 extending in the vertical direction in the drawing. Now, assuming, in FIG. 2A, that the display devices 121A to 121C are each facing the front, to make the display devices 121A to 121C face the back, for example, the user rotates the portion of the unit 101-1 above the dashed-line circle 102-1 to the right in the drawing, thereby obtaining the state as shown in FIG. 2B. Thereafter, the portion of the unit 101-1 above the dashed-line circle 102-1 is further rotated to the right in the drawing, whereby, as shown in FIG. 2C, the display devices 121A to 123C are made to face the back.

Each of the units 101-1 to 101-3 includes a sensor for detecting a rotation angle, such as a potentiometer or a rotary encoder, and via a connector or the like that will be described later, notifies each of the display devices mounted to the unit itself of information indicating its own rotational state (information indicating whether the unit is facing the front or back) in the form of, for example, an electrical signal.

Note that the front and back sides of the scalable television system 100 are not particularly limited. That is, the front side is not limited to the surface as seen from the direction indicated by the arrow 141, nor is the back side limited to the surface as seen from the direction indicated by the arrow 142. Either of the surfaces may be regarded as the front side. That is, since the surface (display section) of each of the display devices 121A to 123C can take two orientations, a surface oriented in one direction is referred to the front side, whereas a surface oriented in the other direction is referred to as the back side.

Figure 3:
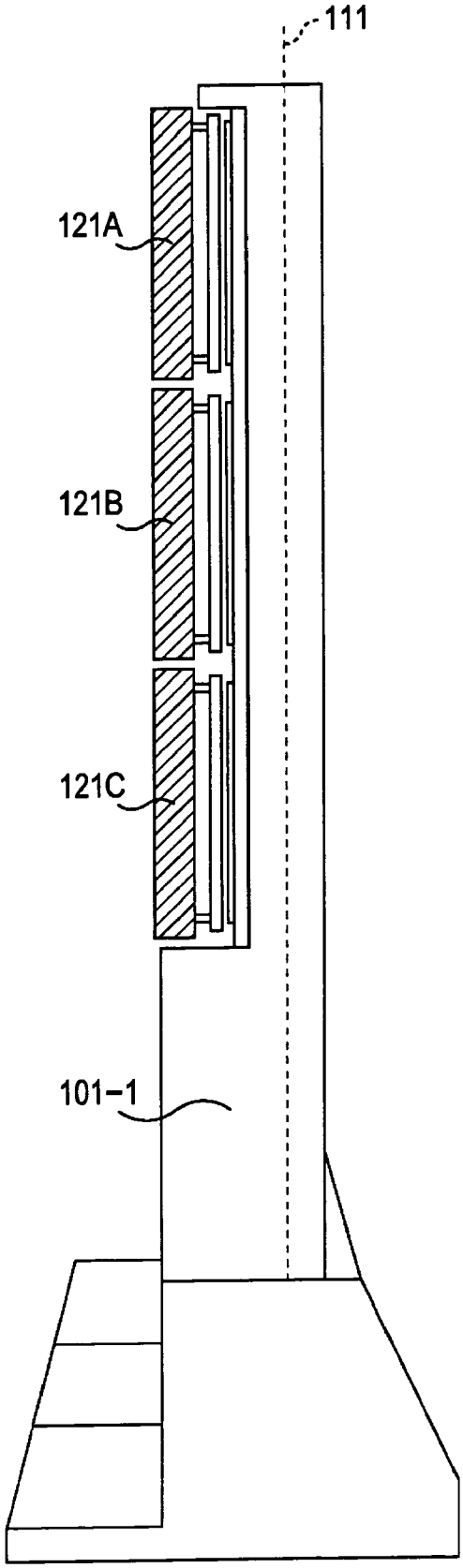
FIG. 3 is a side view of the unit shown in FIG. 1 as seen from the horizontal direction.

FIG. 3 is a side view of the unit 101-1 as seen in the direction from the left of FIG. 1. As shown in the drawing, the display devices 121A to 121C of the same configuration are mounted in a row in the vertical direction of the drawing. In each of the display devices 121A to 121C, the display section formed by an LCD or the like, and the sound output section such as a speaker are provided on the left-hand side surface (front surface) in the drawing. Further, as will be described later with reference to FIG. 4, each of the display devices 121A and 121C is mounted such that its right-hand side surface in the drawing (back surface) is partially or entirely in contact with a predetermined mounting position provided in the unit 101-1.

In the present state, the image displayed on each display section, or the sound output from each sound output section is viewed or listened to by the user on the left-hand side of the unit 101-1 in the drawing. As described above with reference to FIGS. 2A to 2C, when the unit 101-1 is rotated by 180° about the axis 111, the display sections and sound output sections of the display devices 121A to 121C move to the right-hand side surface in the drawing so that conversely to the above state, the image displayed on each display section, or the sound output from each sound output section is viewed or heard by the user on the right-hand side of the unit 101-1 in the drawing. Further, the display devices 121A to 121C can be mounted to or detached from the unit 101-1 as required by the user.

Figure 4:
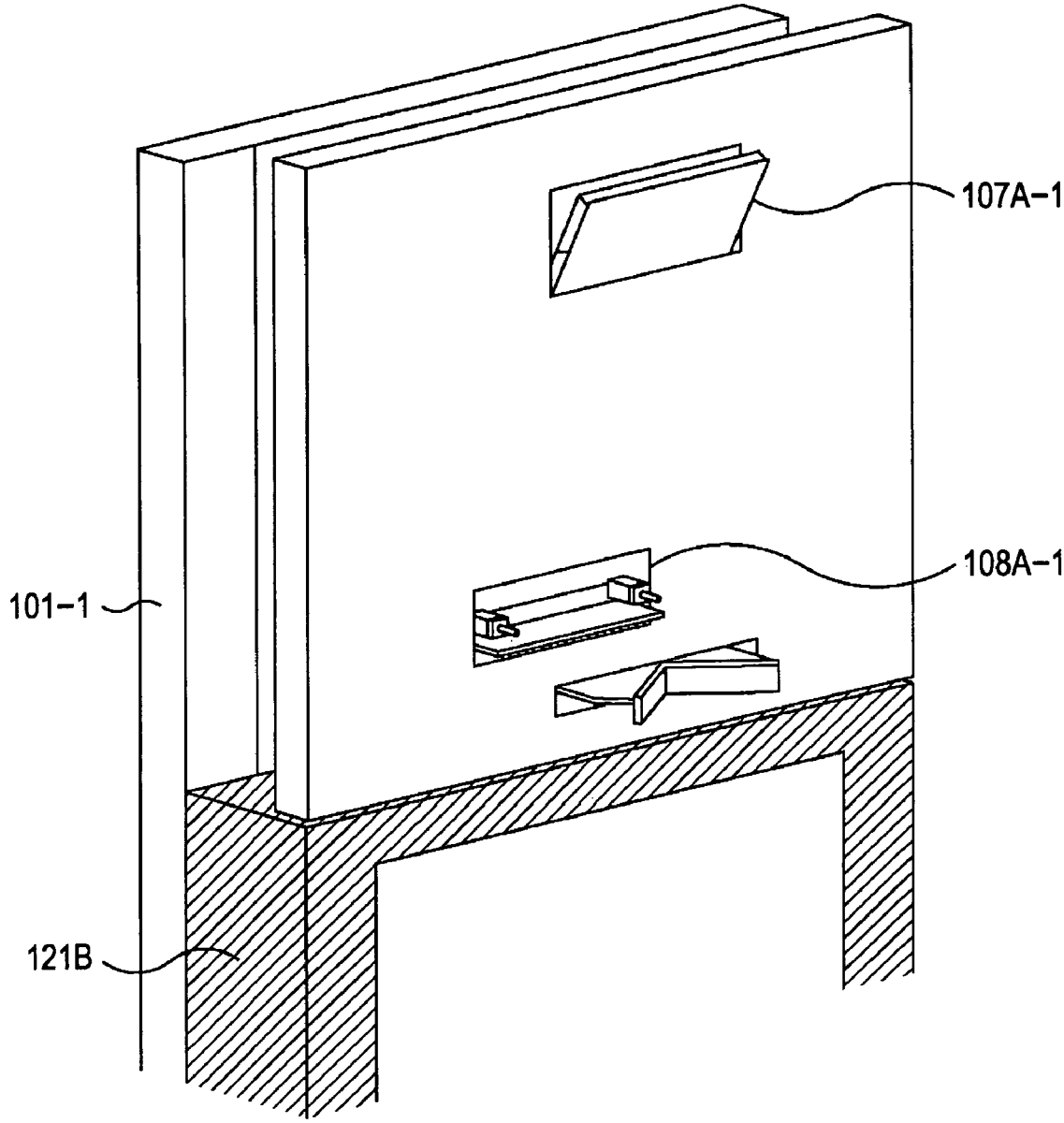
FIG. 4 is a view showing an example of the state where a display device has been detached from the unit.

FIG. 4 is a view showing a case where the display device 121A has been detached from the unit 101-1. The display device 121A is latched onto a mounting portion 107A-1 of the unit 101-1 by means of a mounting bar provided on its back surface. Further, a connector pin or the like provided to the back surface of the display device 121A is connected to a connector 108A-1 of the unit 101-1, thereby enabling communication with the unit 101-1 and other display devices. Further, in the unit 101-1, like the connector 108A-1, connectors 108B-1 and 108C-1 are provided at the mounting positions of the display devices 121B and 121C.

For example, a cable is wired along the axis 111 in the unit 101-1, and the connectors 108A-1 and 108C-1 are each connected to the cable. The display devices 121A to 121C can thus perform communication with each other via the connectors 108A-1 to 108C-1.

Further, the connector 108A-1 previously stores information indicating the position of the connector (which in the present case is the uppermost position in the unit 101-1). The position information is supplied to the display device as required.

Note that the unit 101-2 and the unit 101-3 are also constructed in the same manner as the unit 101-1, and the respective units are connected to each other by means of a cable (not shown). Further, the individual units may be connected in a cascaded manner such that the unit 101-2 and the unit 101-1 are connected to each other, the unit 102-3 and the unit 101-2 are connected to each other, and so on. Accordingly, the nine display devices 121A to 123C can each perform mutual communication with another display device.

Further, external equipment such as an interphone can be connected to the scalable television system 100 and, as required, the image of a monitor connected to the interphone can be displayed on each display device.

As described above with reference to FIGS. 2A to 2C, in the scalable television unit 100 constructed as described above can be rotated on a unit-by-unit basis. By rotating the units, the state of the scalable television system 100 is changed as shown in FIGS. 5 to 7.

Figure 5:
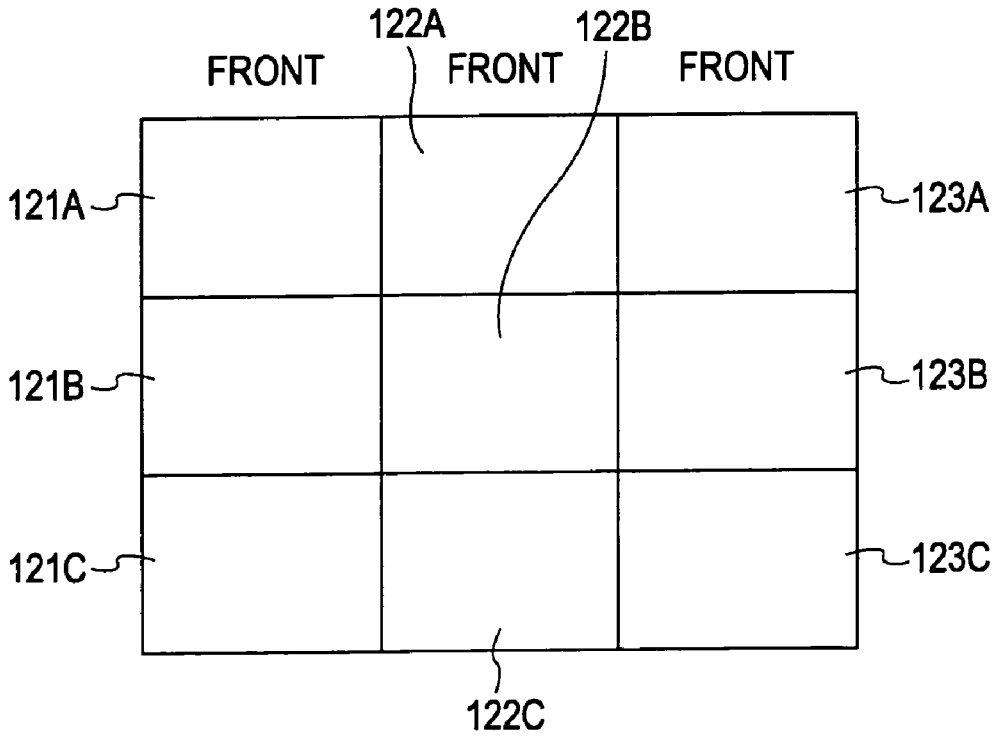
FIG. 5 is a diagram showing an example of the state where all of the units of the scalable television system face the front.
Figure 6:
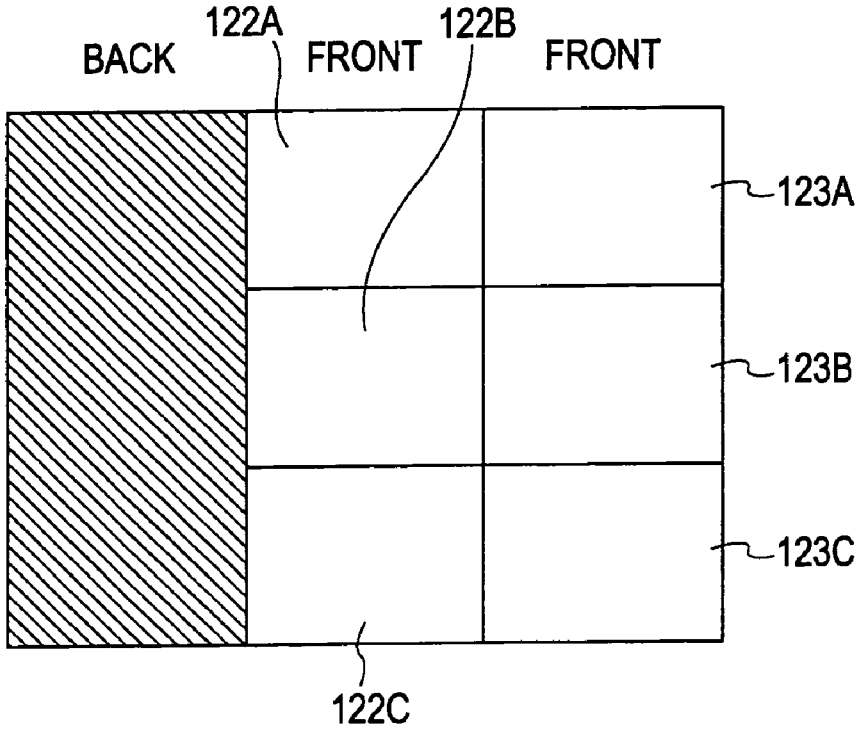
FIG. 6 is a diagram showing an example of the state where some of the units of the scalable television system face the back.
Figure 7:
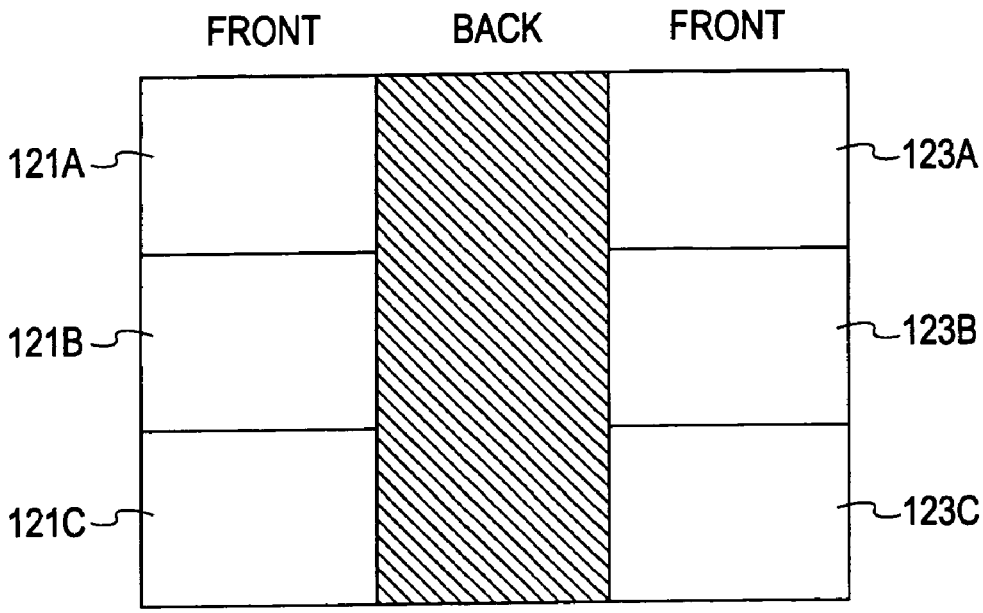
FIG. 7 is a diagram showing an example of the state where some of the units of the scalable television system face the back.

FIGS. 5 to 7 are simplified illustrations of the scalable television system 100. As described above with reference to FIG. 1, the display devices 121A to 123C are respectively mounted to the units 101-1 to 101-3. The character "front" or "back" written on the upper side of the drawings indicate whether (the display sections of) the respective display devices 121A to 123C face the front or the back depending on the rotation states of the corresponding units. Further, in the same drawings, the hatched portion indicates that the display section of the corresponding display device faces the back and thus cannot be viewed from the front side. Further, in the following description, the scalable television system 100 is described while being illustrated in the simplified fashion as shown in FIGS. 5 to 7 as required.

FIG. 5 is a diagram showing a case in which none of the units 101-1 to 101-3 has been rotated in the scalable television system 100. That is, FIG. 5 shows a state in which all of the nine display devices 121A to 123C face the front. In this state, the user viewing the scalable television system 100 from the front side views the image displayed by each of the nine display devices 121A to 123C, whereas the user viewing the scalable television system 100 from the back side cannot view the image.

FIG. 6 is a diagram showing a case in which the unit 101-1 has been rotated by 180° in the scalable television system 100. That is, six display devices, the display devices 122A to 123C, face the front, and the other three display devices, the display devices 121A to 121C, face the back. In this state, the user viewing the scalable television system 100 from the front side views the image displayed by each of the six display devices 122A to 123C, while the user viewing the scalable television system 100 from the back side views the image displayed by each of the three display devices 121A to 121C.

FIG. 7 is a diagram showing a case in which the unit 101-2 has been rotated by 180° in the scalable television system 100. That is, six display devices, the display devices 121A to 121C and the display devices 123A to 123C, face the front, and the other three display devices, the display devices 122A to 122C, face the back. In this state, the user viewing the scalable television system 100 from the front side views the image displayed by each of the six display devices 121A to 121C and 123A to 123C, while the user viewing the scalable television system 100 from the back side views the image displayed by each of the three display devices 122A to 122C.

Figure 8:
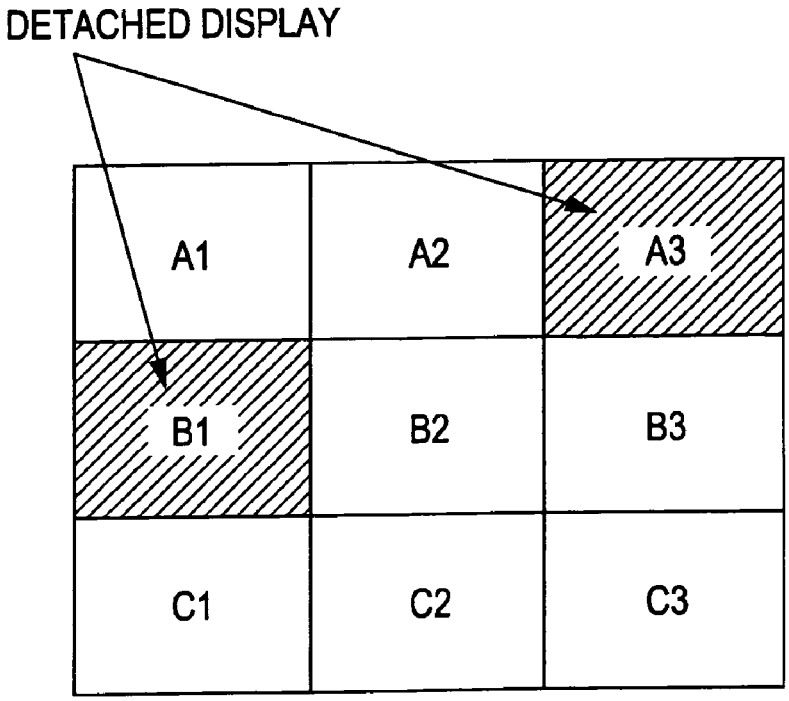
FIG. 8 is a diagram illustrating the positions of display devices of the scalable television system.

Further, as described with reference to FIG. 4, in the scalable television system 100, the individual display devices can be detached from the corresponding units. Thus, for instance, the scalable television system 100 can be in a state where the display devices are detached therefrom as shown in FIG. 8. FIG. 8 is a diagram showing which display devices are being mounted to or detached from the scalable television system 100. In FIG. 8, the display device mounting positions in the units 101-1 to 101-3 are indicated as positions A1 to C3. That is, the uppermost mounting position (the position of the display device 121A) in the unit 101-1 corresponds to the position A1, and the lowermost mounting position (the position of the display device 123C) in the unit 101-3 corresponds to the mounting position C3.

In the example shown in FIG. 8, the respective display devices at the positions A3 and B1 indicated by the diagonal lines in the drawing have been detached. In this state, the display devices 123A and 121B have been detached. Naturally, no image is displayed at those positions irrespective of the rotation directions of the corresponding units.

Further, as will be described later, the mounting positions (positions A1 to C3) of the respective display devices shown in FIG. 8 are used as IDs of the respective display devices included in the scalable television system 100.

FIG. 9 is a block diagram showing an example of the internal configuration of the display devices 121A to 123C.

In this example, a control information communication section 201 is provided in each of the display devices 121A to 123C. The control information communication section 201 is connected via a connector pin or the like to, for example, a connector such as the connector 108A-1 of the unit 101-1. The control information communication section 201 acquires ID information that is the above-described position information, and transmits/receives data indicating the state of the display device to which the control communication section 201 itself belongs (hereinafter, referred to as the "self device") (whether the self device is facing the front or the back) or the state of a display device mounted at another position. Further, as required, control information communication section 201 acquires sensor information corresponding to a command transmitted in the form of an infrared signal, for example, from a remote commander (remote control) (not shown).

While a remote control receiving section (not shown) including an infrared sensor or the like is provided in each of the display devices 121A to 123C, in the scalable television system 100, a signal from a remote control received by a predetermined display device is broadcast to another display device as required.

For example, when six of the nine display devices face the front and the other three display devices face the back, of the six display devices facing the front, the display device located at the lower leftmost position receives a signal from the remote control on behalf of the six display devices, and broadcasts the command of the signal it has received to the other five display devices facing the same direction as itself. On the other hand, of the three display devices facing the back, the display device located at the lower leftmost position receives a signal from the remote control on behalf of the three display devices, and broadcasts the command of the signal it has received to the other two display devices facing the same direction as itself. In this way, both the user viewing or listening to the system from the front side and the user viewing or listening to the system from the back side can freely input desired signals, and the occurrence of variations in command reception state is suppressed even when a large number of display devices are provided.

A central processing section 201 performs processing relating to the configuration of the scalable television system 100 on the basis of information acquired from the control information communication section 201, generates an overall configuration table indicating the states of the display devices at respective positions in the scalable television system 100, and stores the overall configuration table in a table storage section 203.

An input section 204 includes, for example, a tuner or the like, and supplies, to an application processing section 205, data to be displayed or output by a display device, such as a video signal (data), a signal of an image or sound of a television broadcast, or a signal of a monitor connected to an interphone.

The application processing section 205 processes the data supplied from the input section 204 by means of the respective modules from a zoom processing section 221 to a security interrupt processing section 226 on the basis of, for example, sensor information transmitted from the remote control, and outputs the resultant data to an output section 206. That is, the application processing section 205 selects a module on the basis of a user command input via the remote control, and causes the module to execute corresponding processing (application processing such as zoom processing or strobe processing that will be described later). Then, the data supplied from the input section 204 is subjected to predetermined processing by the respective modules from the zoom processing section 221 to the security interrupt processing section 226, whereby image display processing such as the zoom processing or strobe processing, which will be described later, is controlled.

Note that the processing in each of the modules from the zoom processing section 221 to the security interrupt processing section 226 will be described later.

The output section 206 outputs a signal corresponding to the data output from the application processing section 205 to, for example, the display section of each display device formed by an LCD or the like, or the sound output section formed by a speaker or the like.

Note that each of the display devices 121A to 123C has the internal configuration as shown in FIG. 9.

Next, referring to the flowchart of FIG. 10, image output processing by each of the display devices 121A to 123Cc will be described. This processing is executed when, for example, the scalable television system 100 is activated.

Figure 11:
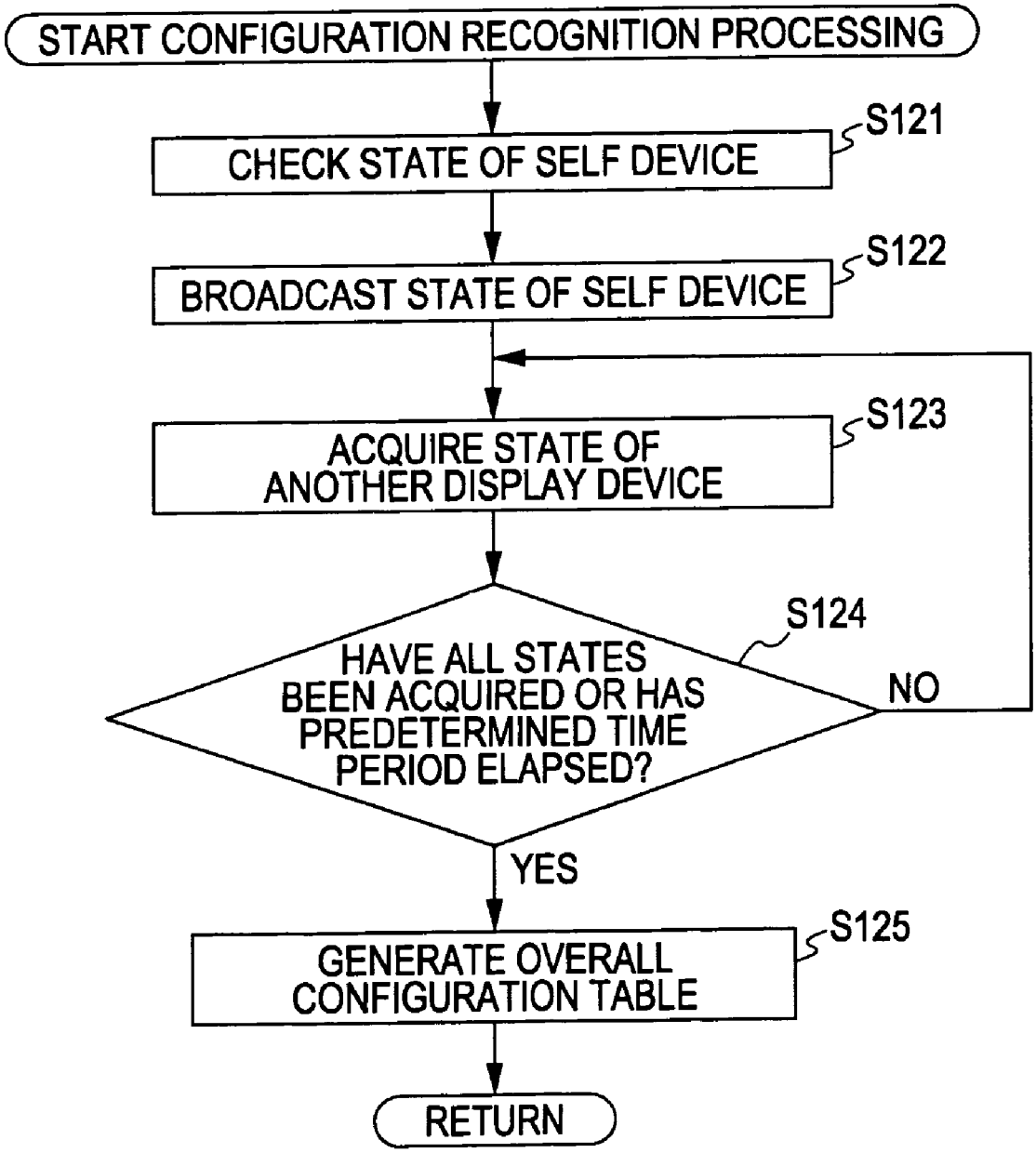
FIG. 11 is a flowchart illustrating an example of configuration recognition processing.

In step S101, the central processing section 202 executes configuration recognition processing that will be described later with reference to FIG. 11. As a result, the overall configuration table, which indicates the states of the display devices at the respective positions in the scalable television system 100 (whether the display devices are currently being mounted or detached, or whether they are facing the front or the back), is generated.

In step S102, the application processing section 205 executes individual application processing on the basis of the results of the configuration recognition processing in step S101. This processing corresponds to each of the modules from the zoom processing section 221 to a multi-view processing section 225 and differs according to the module selected. The details of the individual application processing will be described later.

In step S103, the central processing section 202 determines whether or not a change in configuration has been detected. For example, when the units constituting the scalable television system 100 are rotated, or when the display devices are detached from (or mounted to) the units, information indicating this is acquired via the control information communication section 201, whereby a change in configuration is detected. When it is determined that a change in configuration has been detected, the processing advances to step S104.

In step S104, the central processing section 202 executes the configuration recognition processing again. Accordingly, an overall configuration table reflecting the change in configuration detected in step S103 is generated.

In step S105, the application processing section 205 executes individual application processing on the basis of the results of the configuration recognition processing in step S104.

When it is determined in step S103 that no change in configuration has been detected, or after the processing of step S104, the processing advances to step S106 where the central processing section 202 determines whether or not a change of application has been commanded. For example, in step S106, a change of application is determined to have been commanded when, on the basis of sensor information from the remote control received via the control information communication section 201, a command indicating the selection (execution) of application has been acquired. The processing then advances to step S107.

In step S107, the application processing section 205 executes individual application processing by the modules corresponding to the command in step S106. At this time, the individual application processing is executed on the basis of the results of the configuration recognition processing in step S101 or step S104.

When it is determined in step S106 that a change of application has not been commanded, or after the processing of step S107, the processing advances to step S108 where the central processing section 202 determines whether or not an interrupt has been detected. For example, an interrupt is determined to have been detected when information indicating the occurrence of a call on the interphone has been acquired via the control information communication section 201. The processing then advances to step S109.

In step S109, the application processing section 205 executes interrupt processing on the basis of the results of the configuration recognition processing in step S101 or step S104. Note that the interrupt processing is processing that is executed by the security interrupt processing section 226, and the details thereof will be described later.

As described above, in each display device of the scalable television system 100, the individual application processing is executed in response to the detection of a change in configuration, a change of application, or an interrupt, and an image (and, as required, also sound) is output.

Further, in the scalable television system 100, the above-described processing is individually executed in each of the display devices 121A to 123C. That is, the scalable television system 100 is not provided with a device specifically dedicated to controlling a change in configuration or the execution state of application, and there is no need to mount the display devices in a manner distinguishing between the master and slave devices; each display device can be made to individually display an image to be displayed by itself in response to a change in the configuration of the scalable television system 100 as a whole. Accordingly, it is possible to provide a (completely) scalable television system that allows the number of units to be connected and also the number of display devices to be mounted to be freely selected.

Further, when the above-described processing is individually executed in each of the display devices 121A to 123C, different kinds of application processing can be simultaneously executed by (the assembly of) the front-facing display devices and (the assembly of) the back-facing display devices.

Next, referring to the flowchart of FIG. 11, the details of the configuration recognition processing in step S101 or S104 of FIG. 10 will be described.

In step S121, the central processing section 202 checks the state of the self device. At this time, information indicating whether the self device is currently facing the front or the back is acquired. For example, in the case of the display device 121A, the central processing section 202 checks the state of the self device by acquiring from the unit 101-1 information indicating whether the self device is currently facing the front or the back via the control information communication section 201.

In step S122, the central processing section 202 broadcasts the state of the self device to another display device via the control information communication section 201. For example, in the case of the display device 121A, upon confirming in step S101 that the self device faces the front, the central processing section 202 outputs information indicating that the self device faces the front to the unit 101-1 via the connector 108A-1.

At this time, information (ID information) indicating the mounting position of the self device is simultaneously output. In the present case, ID information "id:A1" corresponding to A1 of FIG. 8, and information indicative of "front" are associated with each other and broadcast to the other display devices 121B and 121C in the unit 101-1. At the same time, the same information is also output to the units 101-2 and 101-3 connected to the unit 101-1 and broadcast to the display devices 122A to 123C as well.

Note that the ID of the self device is acquired in the following manner, for example. As described above, for example, from the information stored in each of the connectors 108A-1 to 108C-1 that are provided in the unit 101-1, each display device connected to the corresponding one of the connectors can confirm its own ordinal position from the top position in the unit 101-1. Then, when the unit 101-1 checks how many units are connected on the left side of itself, and the resulting information is supplied to the display devices 121A to 121C via the connectors 108A-1 and 108C-1, the display devices 121A to 121C can each acquire its own ID.

For example, in the case of the display device 121A, since the display device 121A is connected to the uppermost connector (connector 108A-1) in the unit, and there is not even a single unit connected on the left side of the unit 101-1 to which the display device 121A itself is mounted, it can be confirmed that the ID (mounting portion) of the display device 121A itself is A (uppermost) 1 (leftmost).

Further, for example, in the case of the display device 123C, since the display device 123C is connected to the lowermost connector in the unit, and there are as many as two units connected on the left side of the unit 101-3 to which the display device 123C itself is mounted, it can be confirmed that the ID (mounting position) of the display device 123C itself is C (lowermost) 3 (third leftmost).

Of course, ID corresponding to the mounting position can be previously stored in each of the display devices 121A to 123C, or the same ID can be previously stored in each of the connectors at the respective mounting positions of the units 101-1 to 101-3.

In step S123, the central processing section 202 acquires the states of other display devices. At this time, in the same manner as the processing in step S122, the ID information broadcast by other display devices and the information indicating whether the self device is currently facing the front or the back are acquired while being associated with each other. For example, in the case of the display device 121A, the states of the display deices broadcast from the display devices 121B and 121C and the display devices 122A to 123C are acquired.

In step S124, the central processing section 202 determines whether the states of all the display devices have been acquired, or whether a predetermined period of time has elapsed, and waits on standby until it is determined that the states of all the display devices have been acquired or the predetermined period of time has elapsed. Information on the total number of the display devices is acquired, for example, from the unit to which the self device is connected. For example, in the case of the display device 121A, it is notified by the unit 101-1 of that the units 101-2 and 101-3 are connected to the scalable television system 100, so that it is found that the maximum of nine display devices can be mounted to the scalable television system 100. However, since it is possible that a display device(s) has been detached from the corresponding unit(s), a display device(s) whose state(s) cannot be acquired even after the elapse of a predetermined period of time is determined to have been detached.

In step S125, the central processing section 125 generates the overall configuration table and stores it in the table storage section 203. At this time, for example, the table as shown in FIG. 12 is generated as the overall configuration table.

FIG. 12 is a diagram showing an example of the overall configuration table. The example of the overall configuration table shown in FIG. 12 corresponds to the states as shown in FIGS. 7 and 8. That is, the states of "A1", "A3", "C2" and "C3" of the ID (id) information are "front", the states of "B1" to "B3" of the ID (id) information are "back", and the states "A2" and "C1" of the ID (id) information are "none" (indicating the detached state).

While IDs from "A1" to "n" are written in the overall configuration table, in the present case, there is no ID after C3 (right-hand side in the drawing), so "none" is written as the corresponding state. For example, when a fourth unit 101-4 is connected to the scalable television system 100, IDs "D1" to "D3" will be written together with the corresponding states. Further, the update time in the overall configuration table indicates the time at which information on the state corresponding to the ID information is acquired, for example.

In this way, the configuration recognition processing is executed, and the overall configuration table is generated. While in the example of FIG. 10 the configuration recognition processing is executed in step S101 or step S104, the configuration recognition processing may be executed each time a predetermined period of time set in advance elapses, for example. This enables a change in configuration to be detected in an efficient manner.

For example, a configuration may be adopted in which the configuration recognition processing is executed every 3 minutes, the overall configuration table is updated on the basis of information on state broadcast from each display device, and when a change has been made to the contents in the state field of the overall configuration table, this is detected as a change in configuration. In this case, for example, a display device with an ID whose update time indicates time that is not less than 3 minutes ago from the current time is determined to have been detached, and the state thereof is changed to "none". The contents in the state field of the overall configuration table are thus changed, which is also detected as a change in configuration.

Next, description will be given of the zoom processing executed by the zoom processing section 221 as one of the modules included in the application processing section 205 shown in FIG. 9. The zoom processing refers to processing for displaying one image while having it enlarged by using a plurality of display devices.

Figure 13:
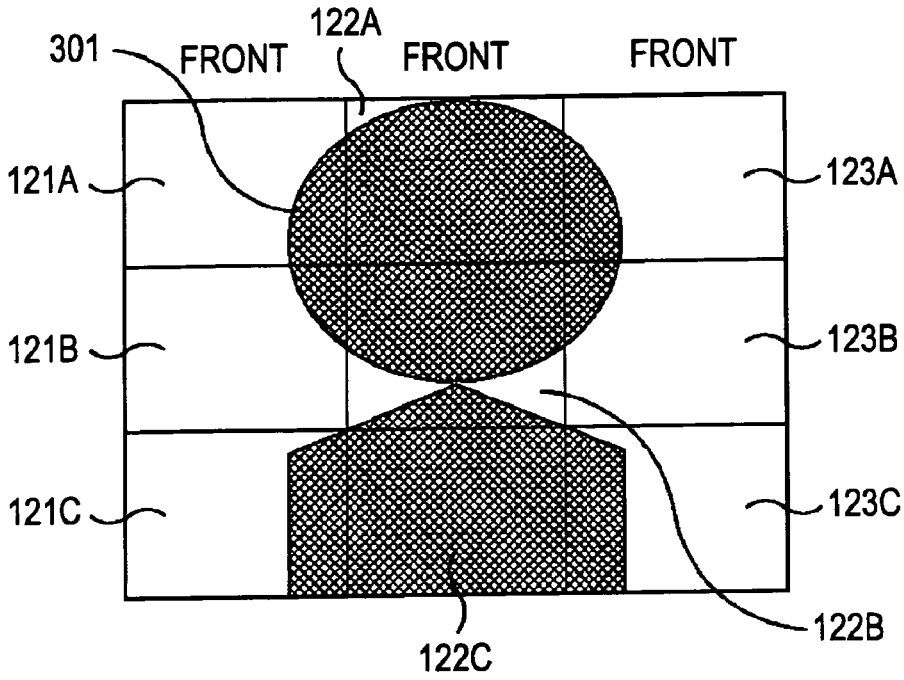
FIG. 13 is a diagram showing an example of an image displayed by zoom processing.
Figure 14:
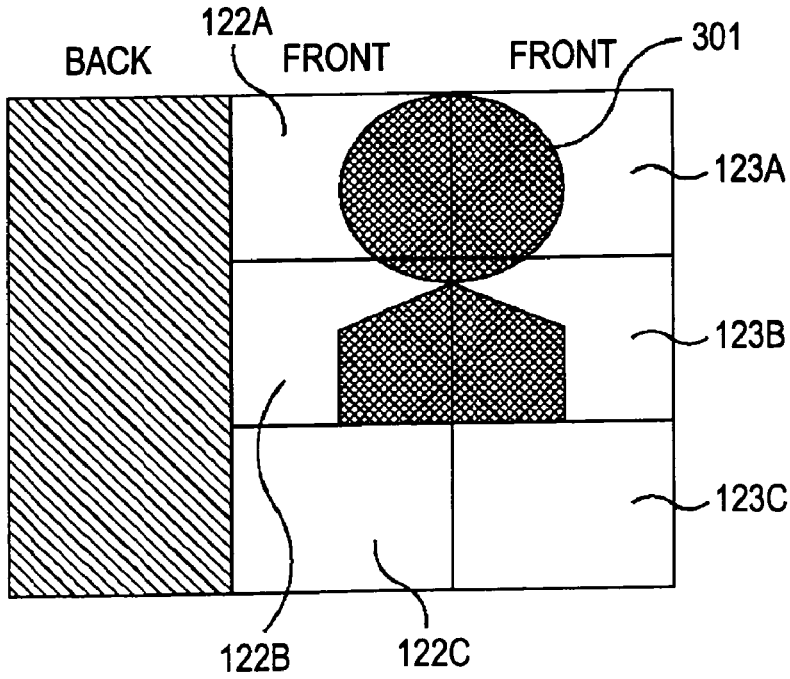
FIG. 14 is a diagram showing another example of an image displayed by zoom processing.
Figure 15:
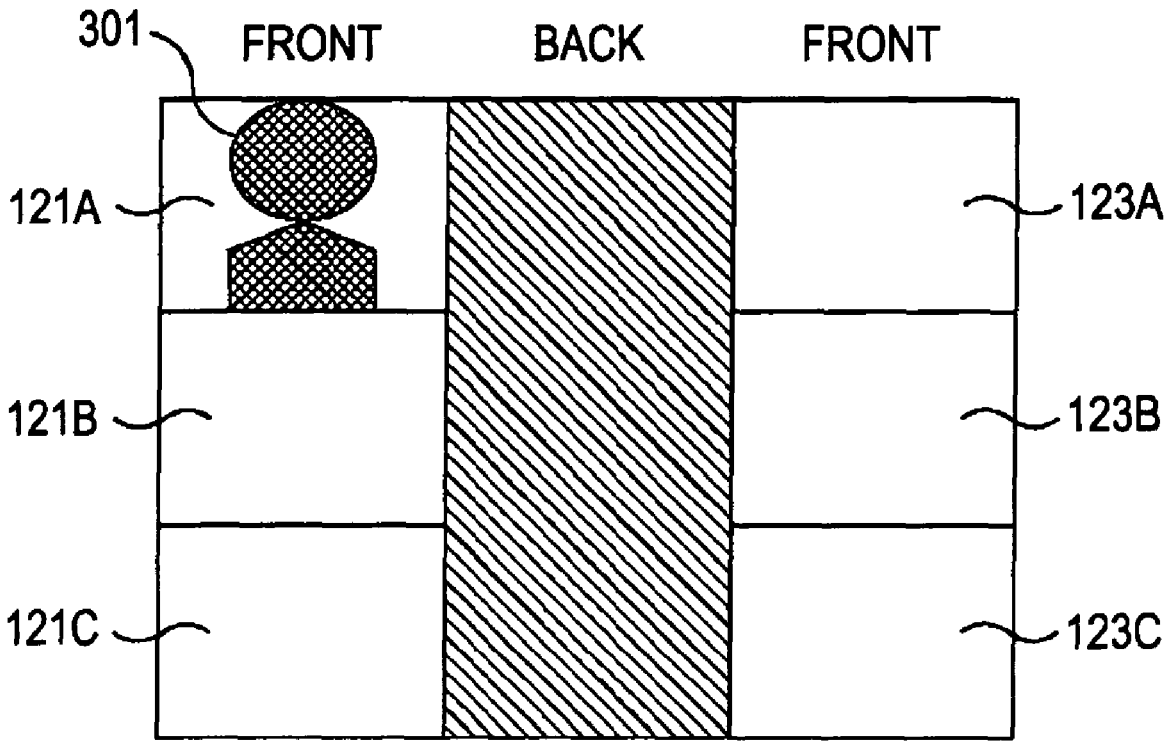
FIG. 15 is a diagram showing yet another example of an image displayed by zoom processing.

FIGS. 13 to 15 are diagrams showing an example of image to be displayed by the zoom processing. In this example, a human-type object 301 is displayed as an image by a plurality of display devices.

FIG. 13 is a diagram showing an example of zoom processing in which none of the units 101-1 to 101-3 has been rotated in the scalable television system 100. In this state, the 9 (3×3) display devices 121A to 123C display one image of the object 301 as if they were a single display device.

FIG. 14 is a diagram showing an example of zoom processing in which the unit 101-1 has been rotated by 180° in the scalable television system 100. In this state, the maximum of 6 (2×3) display devices, the display devices 122A to 123C, can be used as the display devices for displaying the image toward the user viewing or listening to the scalable television system 100 from the front side. However, in order to make the vertical and horizontal lengths of the screen equal, only 4 (2×2) display devices can be used. Accordingly, the 4 (2×2) display devices 122A, 122B, 123A, and 123B display one image of the object 301 as if they were a single display device.

FIG. 15 is a diagram showing an example of zoom processing in which the unit 101-2 has been rotated by 180° in the scalable television system 100. In this state, the maximum of 6 display devices, the display devices 121A to 121*c* and 123A to 123C, can be used as the display devices for displaying the image toward the user viewing or listening to the scalable television system 100 from the front side. However, since the display devices 122A to 122C face the back, the image cannot be displayed in a continuous form by the six display devices. Further, in order to make the vertical and horizontal lengths of the screen equal, only one display device can be used. Accordingly, one image of the object 301 is displayed on the display device 121A.

Figure 16:
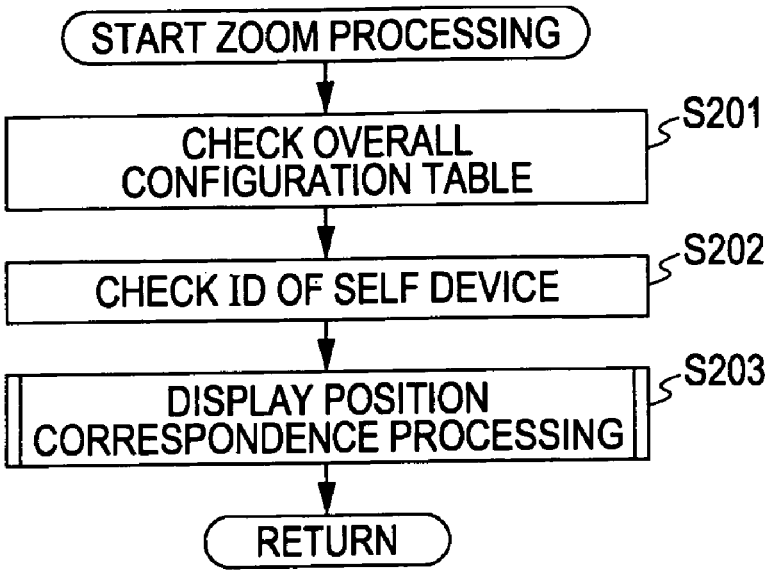
FIG. 16 is a flowchart illustrating an example of zoom processing.

Next, referring to the flowchart of FIG. 16, detailed description will be given of the zoom processing as one kind of the individual application processing in step S102, S105, or S107 of FIG. 10. This processing is executed in step S102, S105, or S107 when, in the application processing section 205, the zoom processing section 221 is selected as the module to execute the processing.

In step S201, the zoom processing section 221 acquires via the central processing section 202 the overall configuration table stored in the table storage section 203, and checks the contents thereof.

In step S202, the zoom processing section 221 checks the ID of the self device. That is, it is checked to which of the display devices mounted at the positions from the position A1 to the position C3 the self device corresponds.

Figure 17:
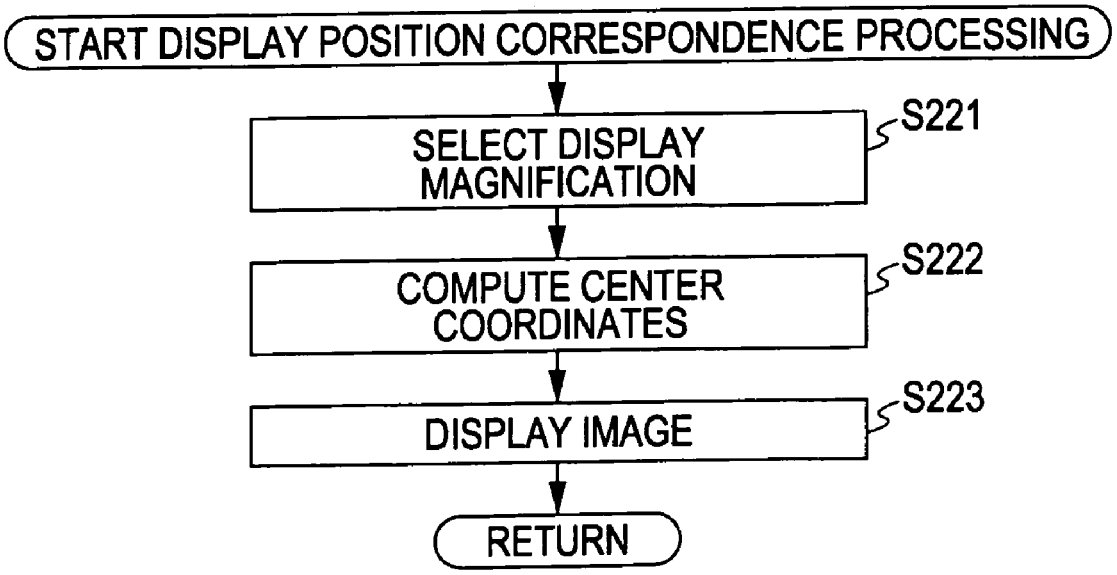
FIG. 17 is a flowchart illustrating an example of display position correspondence processing.

In step S203, the zoom processing section 221 executes display position correspondence processing that will be described later with reference to FIG. 17. As a result, on the basis of the overall configuration confirmed in step S201, an image corresponding to the position of the self device confirmed in step S202 is displayed.

Now, referring to the flowchart of FIG. 17, the display position correspondence processing in step S203 of FIG. 16 will be described in detail.

In step S221, the zoom processing section 221 selects a display magnification.

In step S222, the zoom processing section 221 computes center coordinates that are the coordinates corresponding to the center position of the portion to be displayed by the self device, out of the entire image to be displayed. That is, when performing the zoom processing, as described above, the portion of the image to be displayed by the self device varies according to the mounting position of the display device. Accordingly, each display device computes the coordinates of the center position of the portion to be displayed by itself.

In step S223, the zoom processing section 221 displays an image at the magnification selected in step S221 with the center coordinates computed in step S222 serving as the center of the image.

A more detailed description will be made on this point with reference to FIGS. 18 to 21. Note that the description will be directed to an example of display position correspondence processing performed by the display device (display device 122A) mounted at the position A2 indicated by the latticed hatching in the drawings.

Figure 18:
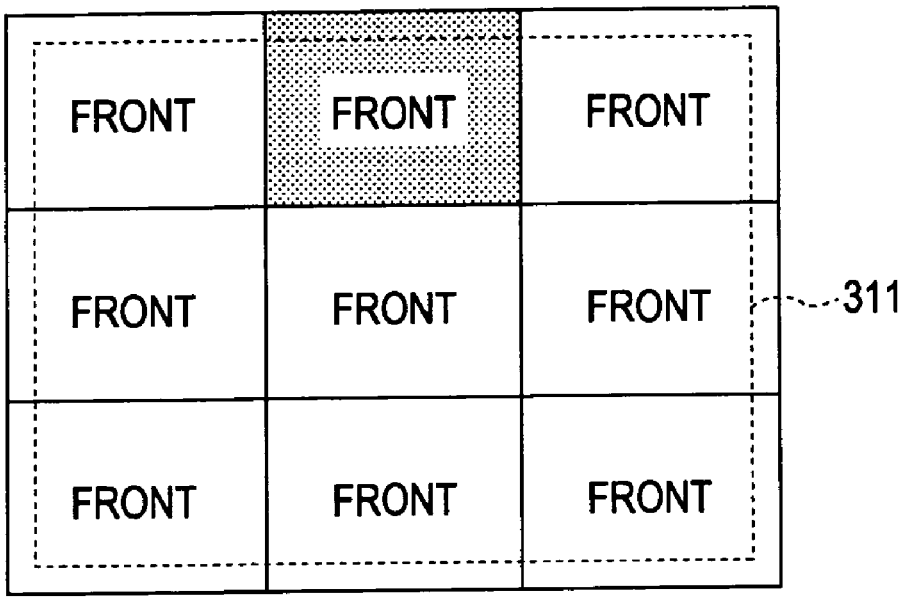
FIG. 18 is a diagram illustrating the details of display position correspondence processing.

FIG. 18 is a diagram showing a case in which none of the units 101-1 to 101-3 has been rotated. In this case, the nine display devices display one image as if they were a single display as described above. That is, the size of the image displayed in this case is represented by a frame 311 indicated by the dotted line in the drawing, which is nine times larger than that when one image is displayed by each individual display device.

In the case, in step S221, 9 is selected as the magnification. In step S222, it is confirmed that the self device is the display device corresponding to the position A2 (of the total of nine display devices, the display device located second from the left and first from the top).

Then, in step S223, the center coordinates are computed by, for example, the following expression.

$$\text{Center coordinates } (x, y)=(w/6+w/3,\ h/6)$$

Here, w represents the length of the frame 311 in the horizontal direction in the drawing (that is, the width of the image), and h represents the length of the frame 311 in the vertical direction of the drawing (that is, the height of the image). Through this computation, the position of the pixel near the center point of the display section of the display device 122A in the image displayed inside the frame 311 is computed as the center coordinates.

Figure 19:
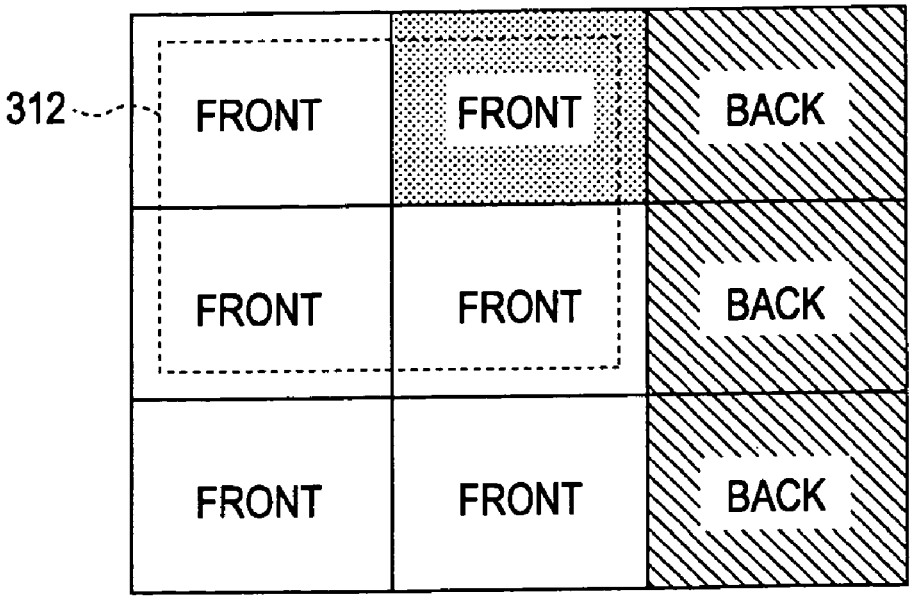
FIG. 19 is a diagram illustrating the details of the display position correspondence processing.

FIG. 19 is a diagram showing a case in which the unit 101-3 has been rotated by 180°. In this case, as described above, four display devices display one image as if they were a single display. That is, the size of the image displayed in this case is represented by a frame 312 indicated by the dotted line in the drawing, which is four times larger than that when one image is displayed by each individual display device.

In this case, in step S221, 4 is selected as the magnification. In step S222, it is confirmed that the self device is the display device corresponding to the position A2 (of the total of four display devices, the display device located second from the left and first from the top).

Then, in step S223, the center coordinates are computed by, for example, the following expression.

$$\text{Center coordinates } (x, y)=(w/4+w/2, h/4)$$

Through this computation, the position of the pixel near the center point of the display section of the display device 122A in the image displayed inside the frame 312 is computed as the center coordinates.

Figure 20:
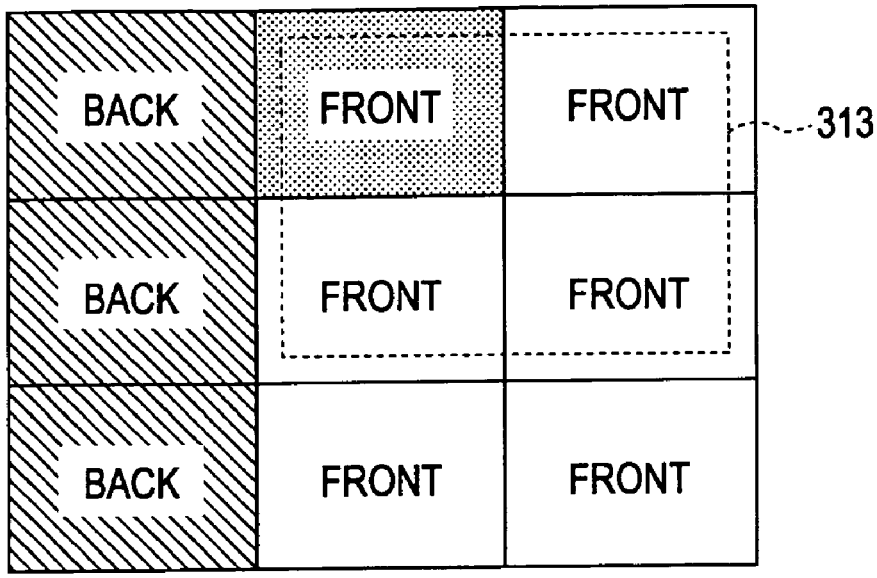
FIG. 20 is a diagram illustrating the details of display position correspondence processing.

FIG. 20 is a diagram showing a case in which the unit 101-3 has been rotated by 180°. In this case as well, four display devices display one image as if they were a single display. That is, the size of the image displayed in this case is represented by a frame 313 indicated by the dotted line in the drawing, which is four times larger than that when one image is displayed by each individual display device.

In this case, in step S221, 4 is selected as the magnification. In step S222, it is confirmed that the self device is the display device corresponding to the position A2 (of the total of four display devices, the display device located second from the left and first from the top).

Then, in step S223, the center coordinates are computed by, for example, the following expression.

$$\text{Center coordinates } (x, y)=(w/4, h/4)$$

Through this computation, the position of the pixel near the center point of the display section of the display device 122A in the image displayed inside the frame 313 is computed as the center coordinates.

Figure 21:
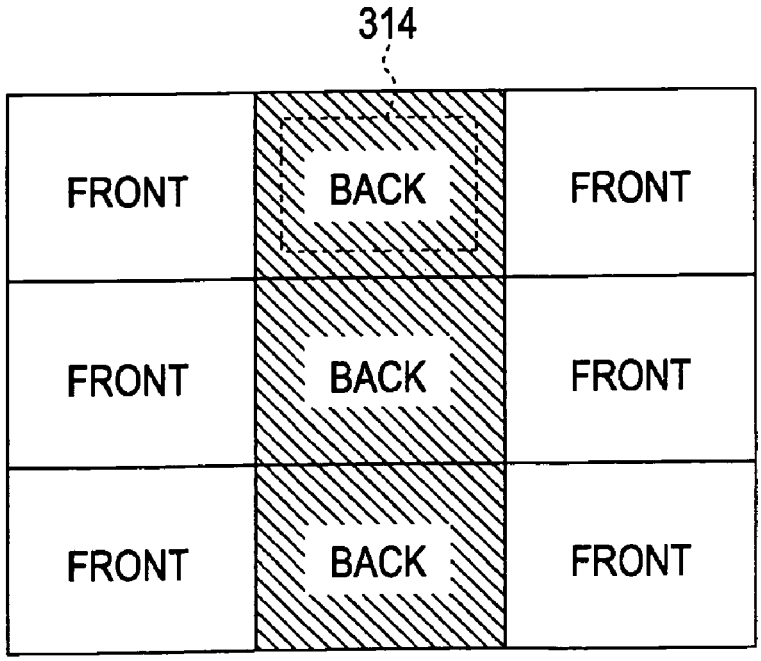
FIG. 21 is a diagram illustrating the details of display position correspondence processing.

FIG. 21 is a diagram showing a case in which the unit 101-2 has been rotated by 180°. In this case, as described above, one display device displays one image. That is, the size of the image displayed in this case is represented by a frame 314 indicated by the dotted line in the drawing, whose magnification is equal to the magnification (1) when one image is displayed by each individual display device.

In this case, in step S221, 1 is selected as the magnification. In step S222, it is confirmed that the self device is the display device corresponding to the position A2 (of the total of one display device, the display device located first from the left and first from the top).

In this case, since the magnification is 1, there is no need to compute the center coordinates in step S223.

The zoom processing is performed in the manner as described above. In this way, an image magnified to an optimum size can be displayed according to the states of the individual display devices of the scalable television system.

Next, description will be given of strobe processing, information extraction processing, and memo processing respectively executed by a strobe processing section 222, an information extraction processing section 223, and a memo processing section 224 that are modules included in the application processing section 205 shown in FIG. 9.

First, the strobe processing will be described. The strobe processing refers to processing whereby moving images are sequentially stilled (frozen) at predetermined time intervals, and the stilled image at each timing is displayed by each of the plurality of display devices. The strobe processing allows the movements of the players to be shown in an easy to follow manner during broadcasting of sports games, for example. In the strobe processing, the still processing for a moving image is sequentially started when the execution of the strobe processing is commanded by the user.

Figure 22:
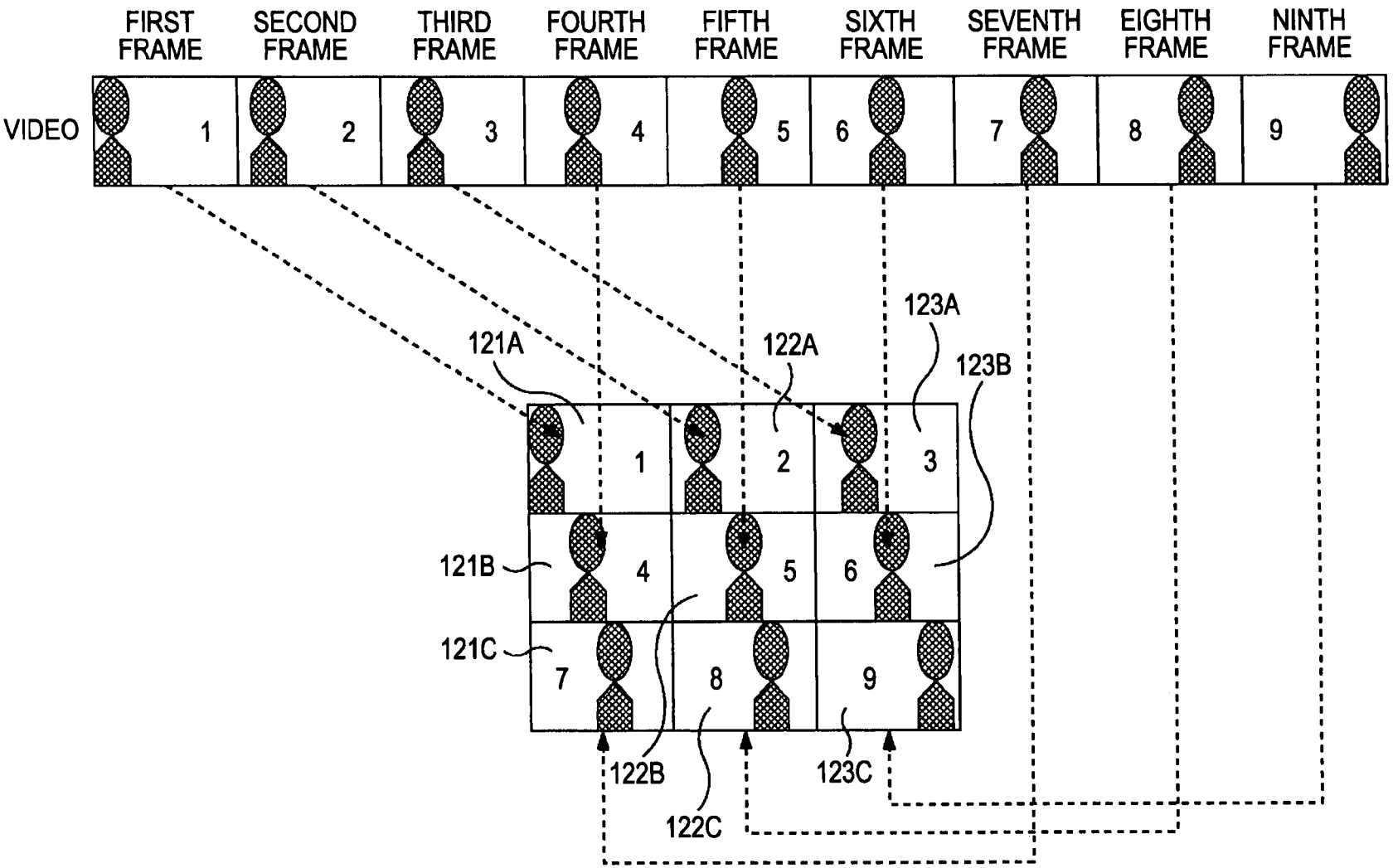
FIG. 22 is a diagram showing an example of an image displayed by strobe processing.

FIG. 22 is a diagram showing an example of image display when strobe processing is executed in the state where none of the units 101-1 to 101-3 has been rotated in the scalable television system 100. FIG. 22 is a diagram showing an example of moving images in which a human-type object moves from the left side of the screen toward the right side thereof. The moving images from the first to ninth frames are sequentially stilled through the strobe processing at time intervals each corresponding to one frame. As indicated by the dotted arrows in the drawing, the images of the respective frames stilled through the strobe processing are respectively displayed by the display devices 121A to 123C.

As shown in the drawing, the image of the first frame is displayed as a still image by the display device 121A, the image of the second frame is displayed as a still image by the display device 122A, the image of the third frame is displayed as a still image by the display device 123A, and so on. In this way, the stilled images (still images) are sequentially displayed. While the images to be displayed by the respective display devices are for the sake of convenience denoted by numbers indicating the order of the first to ninth frames, in actuality, these numbers are not displayed.

Figure 23:
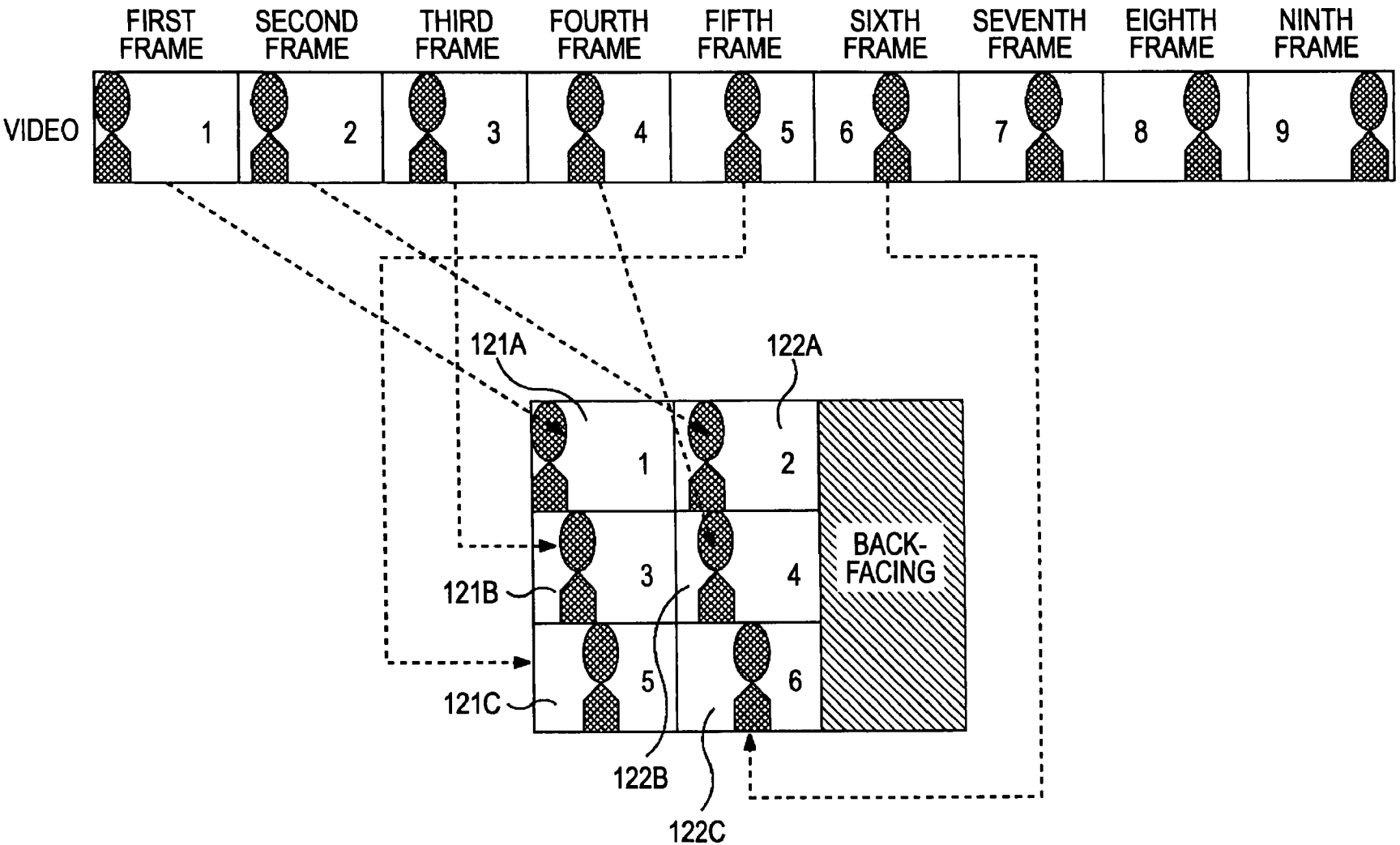
FIG. 23 is a diagram showing an example of an image displayed by strobe processing.

FIG. 23 is a diagram showing an example of image display when strobe processing is executed in the state where the unit 101-3 has been rotated in the scalable television system 100. In FIG. 23, unlike in the case of FIG. 22, the display devices 123A to 123C face the back and thus cannot display images due to strobe processing. Accordingly, the stilled images (still images) are sequentially displayed in such a manner that the image of the first frame is displayed as a still image by the display device 121A, the image of the second frame is displayed as a still image by the display device 122A, the image of the third frame is displayed as a still image by the display device 121B, and so on. The images of the seventh to ninth frames are not displayed.

Figure 24:
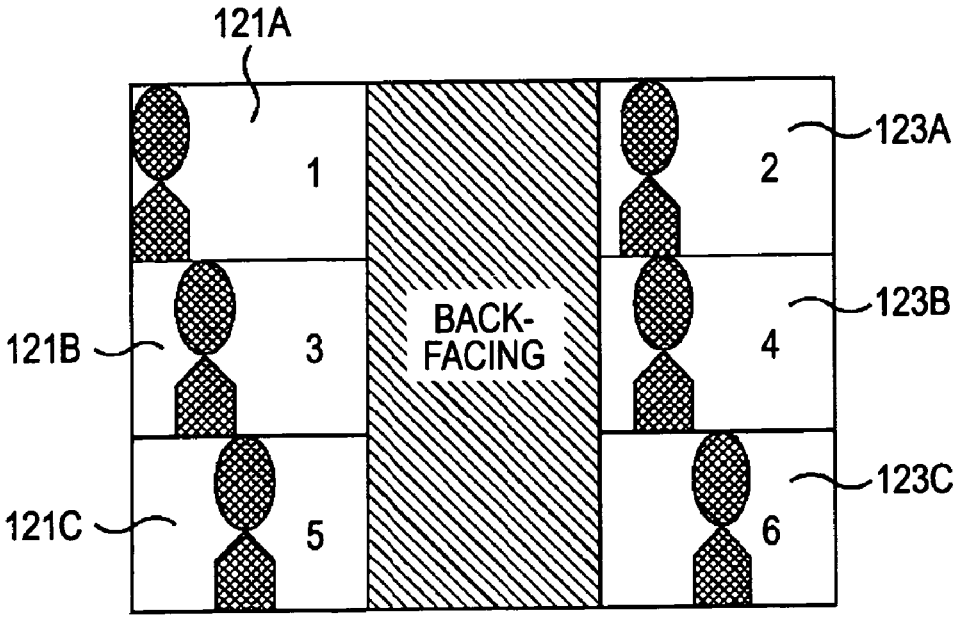
FIG. 24 is a diagram showing an example of an image displayed by strobe processing.

FIG. 24 is a diagram showing an example of image display when strobe processing is executed in the state where the unit 101-2 has been rotated in the scalable television system 100. FIG. 24, unlike in the case of FIG. 22, the display devices 122A to 122C face the back and thus cannot display images due to strobe processing. Accordingly, the stilled images (still images) are sequentially displayed in such a manner that the image of the first frame is displayed as a still image by the display device 121A, the image of the second frame is displayed as a still image by the display device 123A, the image of the third frame is displayed as a still image by the display device 121B, and so on. The images of the seventh to ninth frames are not displayed.

Figure 25:
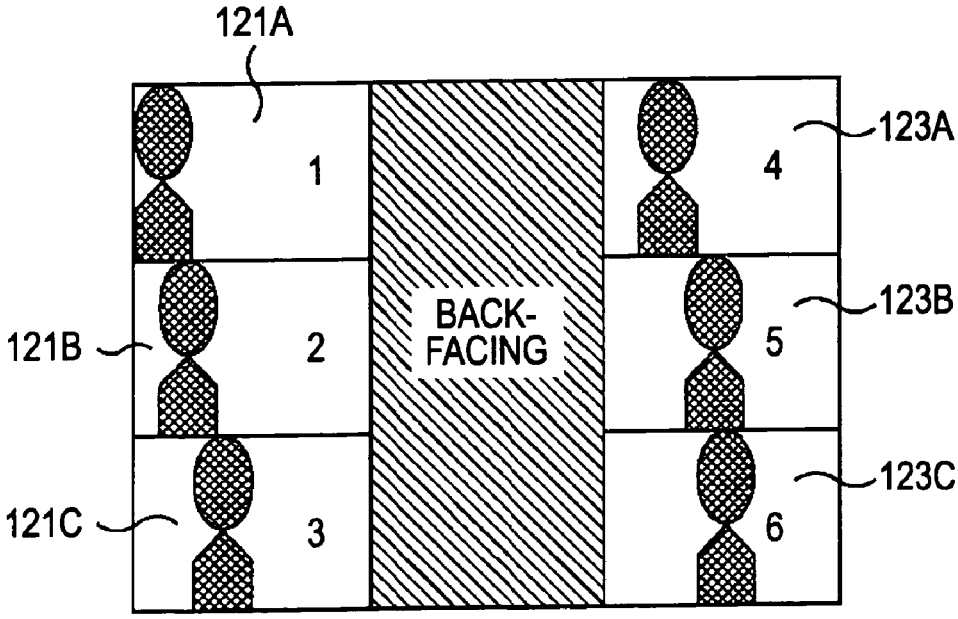
FIG. 25 is a diagram showing an example of an image displayed by strobe processing.

Further, in the scalable television system 100, the order in which images are displayed by the respective display devices can be arbitrarily set. For example, the image display order shown in FIG. 24 can be changed to one as shown in FIG. 25. In the case of FIG. 25, the stilled images (still images) are sequentially displayed in such a manner that the image of the first frame is displayed as a still image by the display device 121A, the image of the second frame is displayed as a still image by the display device 121B, the image of the third frame is displayed as a still image by the display device 121C, and so on.

Figure 26:
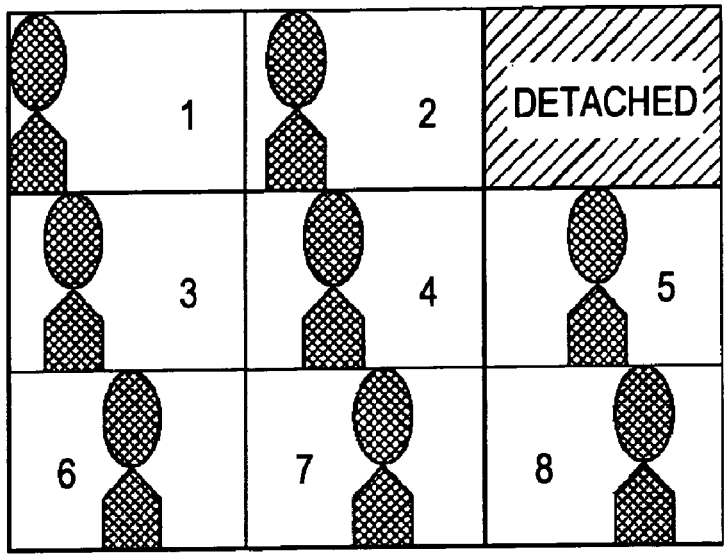
FIG. 26 is a diagram showing an example of an image displayed by strobe processing.

Further, as described above, in the scalable television system 100, the display devices can be individually detached from the corresponding units. FIG. 26 show an example of image display when the strobe processing is executed in the state where the display device 123A has been detached from the scalable television system 100. In FIG. 26, unlike in the case of FIG. 22, an image due to strobe processing cannot be displayed at the position (position A3) of the display device

123A indicated by the hatching in the drawing. Accordingly, the stilled images (still images) are sequentially displayed in such a manner that the image of the first frame is displayed as a still image by the display device 121A, the image of the second frame is displayed as a still image by the display device 122A, the image of the third frame is displayed as a still image by the display device 121B, and so on. The image of the ninth frame is not displayed.

Next, the information extraction processing will be described. The information extraction processing refers to processing whereby a broadcast image is sequentially made still at each of the timings when a specific image such as a telop is displayed in the broadcast image, and the stilled images at the respective timings are sequentially displayed on a plurality of display devices. Note that a normal image (moving image) continues to be displayed on one of the plurality of display devices. The information extraction processing allows, for example, the recipe displayed on the screen to be shown in an easy to follow manner while the user watches a cooking program or the like, for example. When the execution of the information extraction processing is commanded by the user, specific images such as telops are automatically detected, and the still processing for the image is sequentially started.

Figure 27:
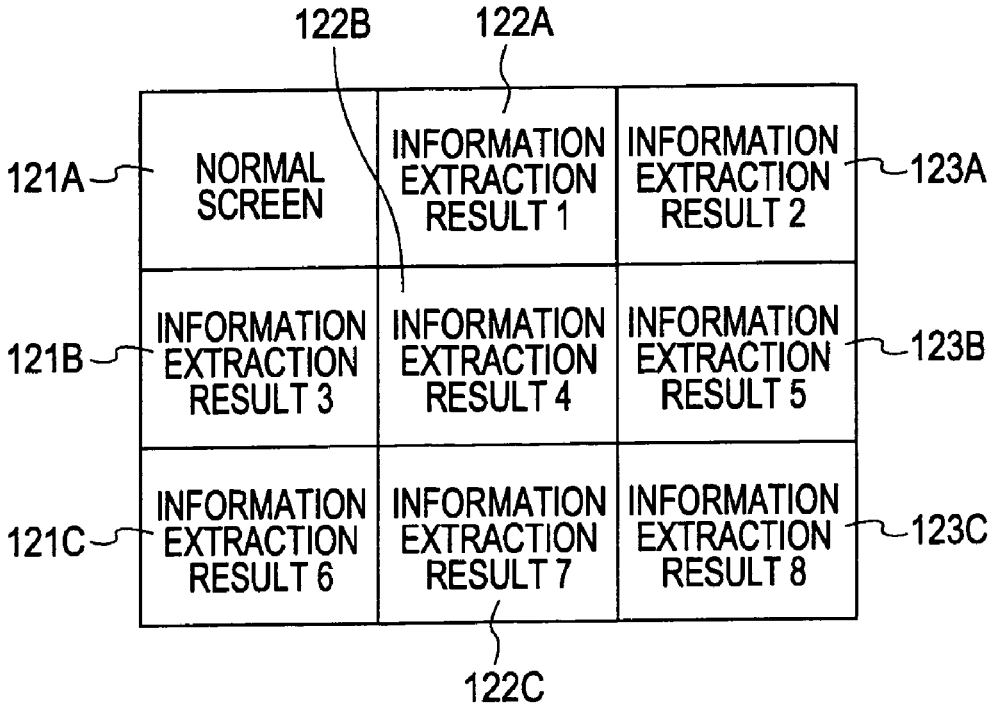
FIG. 27 is a diagram showing an example of an image displayed by information extraction processing.

FIG. 27 is a diagram showing an example of image display when the image extraction processing is executed in the state where none of the units 101-1 to 101-3 has been rotated in the scalable television system 100. In the example of the drawing, images with telops displayed thereon that have been automatically detected are sequentially stilled in the form of information extraction results 1 to 8. Note that in this example, a normal image continues to be displayed on the display device located on the most upper left side (which is the display device 121A in the present case) in the scalable television system 100.

As shown in the drawing, the stilled images (still images) are sequentially displayed in such a manner that the information extraction result 1 (the still image at the timing when a telop is detected for the first time) is displayed as a still image by the display device 122A, the information extraction result 2 (the still image at the timing when the telop is detected for the second time) is displayed as a still image by the display device 123A, the information extraction result 3 (the still image at the timing when the telop is detected for the third time) is displayed as a still image by the display device 121B, and so on.

Note that in the information extraction processing, the display device that displays the normal image is not limited to the one display device on the most upper left side but can be set in an arbitrary manner.

Figure 28:
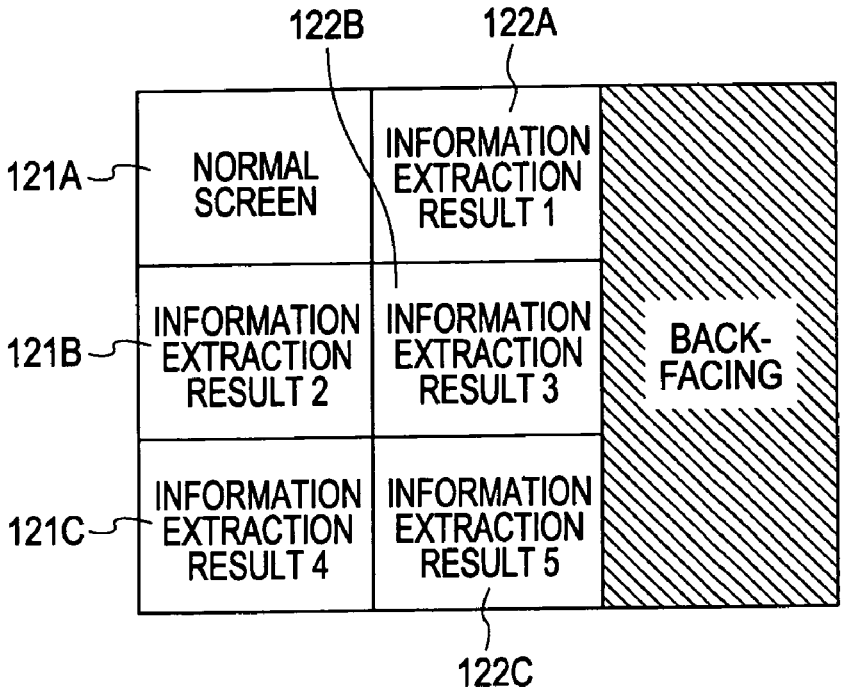
FIG. 28 is a diagram showing another example of an image displayed by information extraction processing.

FIG. 28 is a diagram showing an example of display device when the information extraction processing is executed in the state where the unit 101-3 has been rotated in the scalable television system 100. In FIG. 28, unlike in the case of FIG. 27, the display devices 123A to 123C face the back and thus cannot display images due to the information extraction processing. Accordingly, the stilled images (still images) are sequentially displayed in such a manner that the information extraction result 1 is displayed as a still image by the display device 122A, the information extraction result 2 is displayed as a still image by the display device 121B, the information extraction result 3 is displayed as a still image by the display device 122B, and so on. The information extraction results 6 to 8 are not displayed.

Note that when a unit(s) other than the unit 101-3 has been rotated, or when the information extraction processing is executed in the state where a display device(s) has been detached from a unit(s), the image display is controlled in the same manner as in FIGS. 24 to 26.

Next, the memo processing will be described. The memo processing refers to processing whereby the broadcast image is stilled at each designated timing, and the still images at the respective still timings are sequentially displayed on the plurality of display devices. Note that a normal image (moving image) continues to be displayed on one of the plurality of display devices. The memo processing allows, for example, access guides or shop descriptions displayed on the screen to be shown in an easy to follow manner while the user watches life information programs, for example. The image is sequentially stilled each time when the execution of still processing is commanded by the user by using a remote control or the like.

Figure 29:
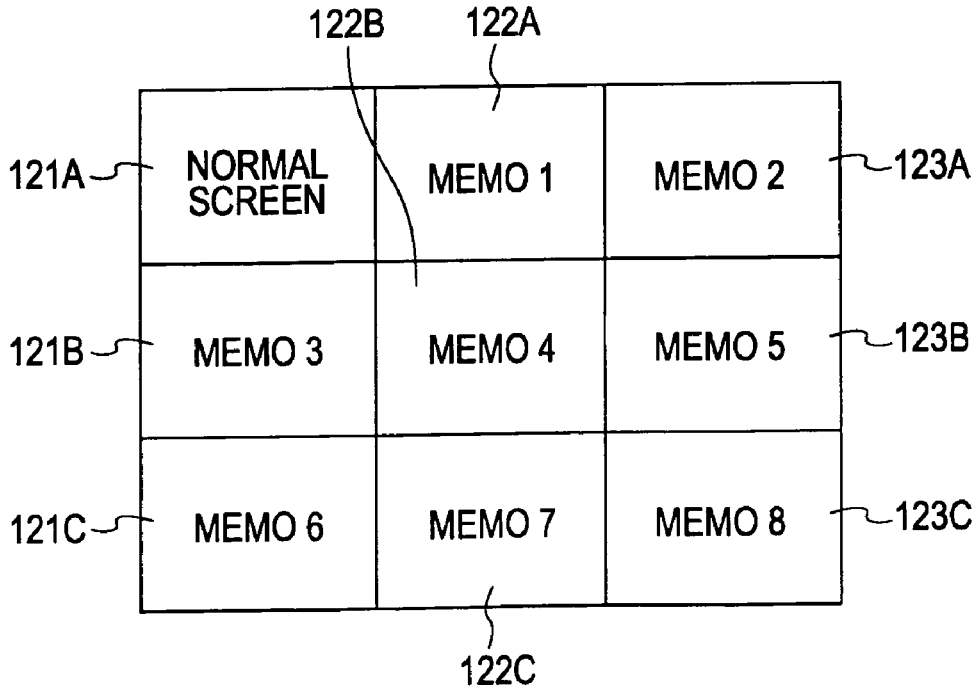
FIG. 29 is a diagram showing an example of an image displayed by memo processing.

FIG. 29 is a diagram showing an example of image display when the memo processing is executed in the state where none of the units 101-1 to 101-3 has been rotated in the scalable television system 100. In the example of the drawing, the images at the timings at which the execution of still processing is commanded by the user are sequentially stilled in the form of a memo 1 to a memo 8. Note that in this example, a normal image continues to be displayed on the display device located on the most upper left side (which in the present case is the display device 121A) in the scalable television system 100.

As shown in the drawing, the stilled images (still images) are sequentially displayed in such a manner that the memo 1 (the still image at the timing when the execution of still processing is commanded for the first time) is displayed as a still image by the display device 122A, the memo 2 (the still image at the timing when the execution of still processing is commanded for the second time) is displayed as a still image by the display device 123A, the memo 3 (the still image at the timing when the execution of still processing is commanded for the third time) is displayed as a still image by the display device 121B, and so on.

Note that in the memo processing, the display device that displays the normal image is not limited to the one display device on the most upper left side but can be set in an arbitrary manner.

Figure 30:
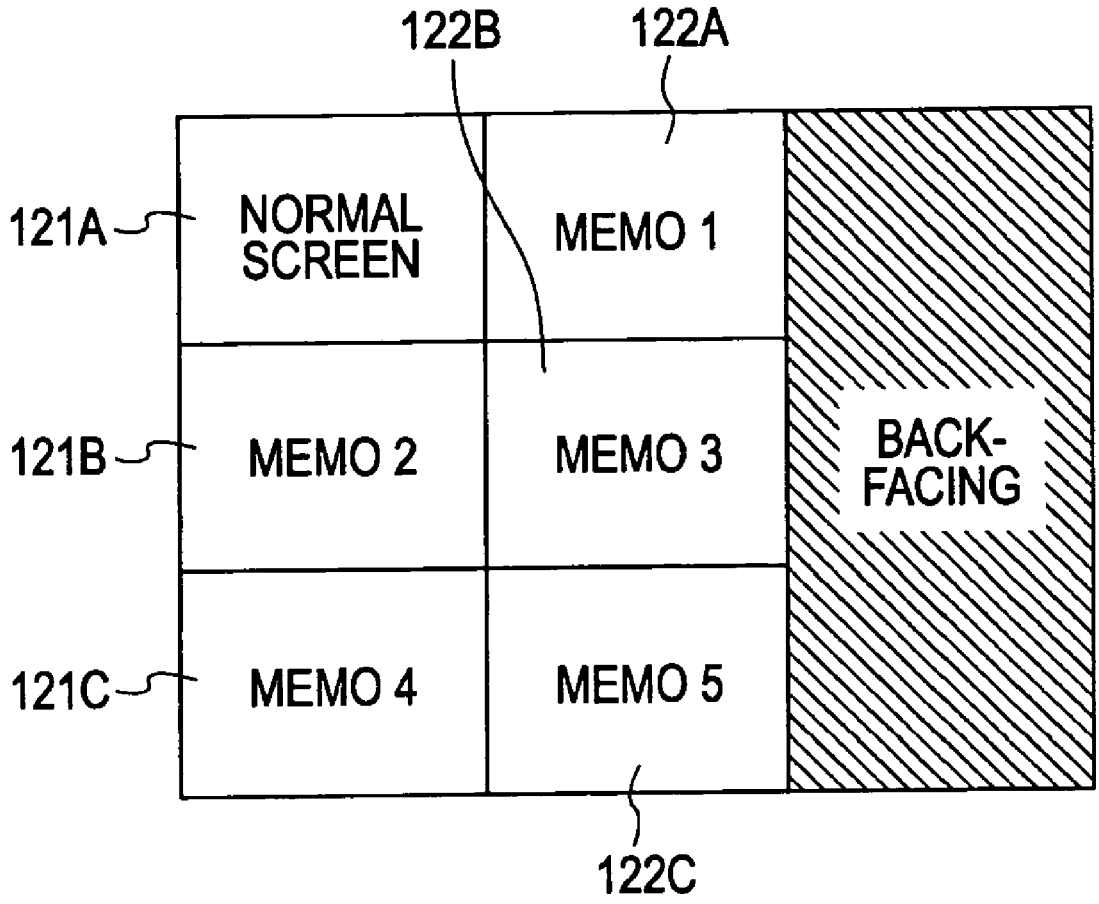
FIG. 30 is a diagram showing another example of an image displayed by memo processing.

FIG. 30 is a diagram showing an example of image display when the memo processing is executed in the state where the unit 101-3 has been rotated in the scalable television system 100. In FIG. 30, unlike in the case of FIG. 29, the display devices 123A to 123C face the back and thus cannot display images due to memo processing. Accordingly, the stilled images (still images) are sequentially displayed in such a manner that the memo 1 is displayed as a still image by the display device 122A, the memo 2 is displayed as a still image by the display device 121B, the image of the memo 3 is displayed as a still image by the display device 122B, and so on. The images of the memos 6 to 8 are not displayed.

Note that when a unit(s) other than the unit 101-3 has been rotated, or when the memo processing is executed in the state where a display device(s) has been detached from a unit(s), the image display is controlled in the same manner as in FIGS. 24 to 26.

As described above, in each of the strobe processing, the information extraction processing, and the memo processing, the display devices mounted to the scalable television system 100 individually still the images at predetermined timings for display. Herein, the strobe processing, the information extraction processing, and the memo processing are collectively referred to as the "time-specific individual display processing".

Figure 31:
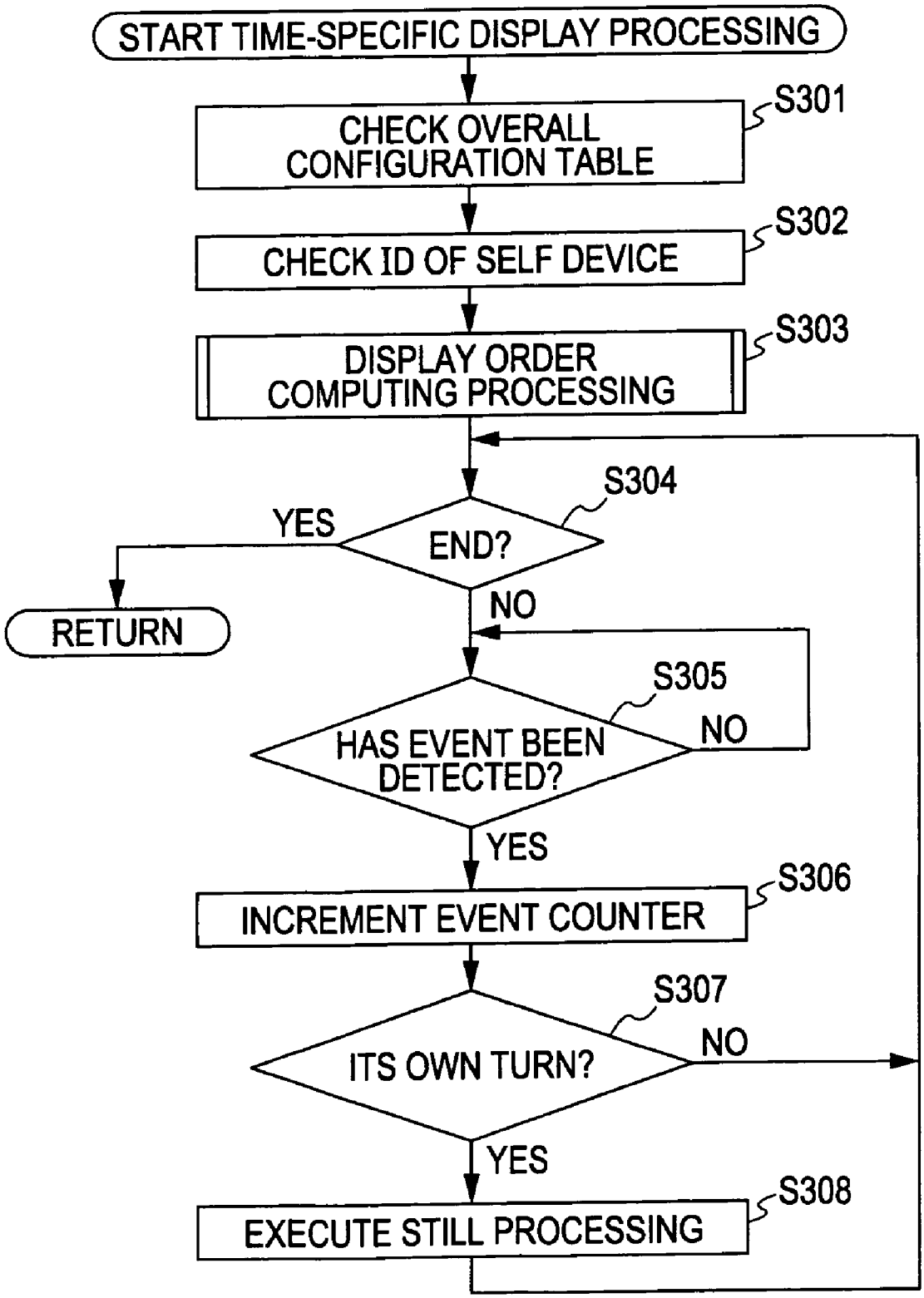
FIG. 31 is a flowchart illustrating an example of time-specific individual display processing.

Next, referring to flowchart of FIG. 31, description will be given of the time-specific individual display processing corresponding to each of the strobe processing, the information extraction processing, and the memo processing respectively executed by the strobe processing section 222, the information extraction processing section 223, and the memo processing 224. That is, the strobe processing, the information extraction processing, and the memo processing will be described collectively as the time-specific individual display processing.

This processing is one kind of the individual application processing in step S102, S105, or S107 of FIG. 10. In the application processing section 205, this processing is executed as the strobe processing when the strobe processing section 222 is being selected as the module to execute processing, as the information extraction processing when the information extraction processing section 223 is being selected as the module to execute processing, and as the memo processing when the memo processing section 224 is being selected as the module to execute processing. Note that in the drawing, the strobe processing section 222, the information extraction processing section 223, and the memo processing section 224 are each collectively referred to as each processing section.

In step S301, each processing section acquires via the central processing section 202 the overall configuration table stored in the table storage section 203, and checks the contents thereof.

In step S302, each processing section checks the ID of the self device. That is, each processing section checks to which of the display devices mounted at the positions A1 to C3 the self device corresponds.

Figure 32:
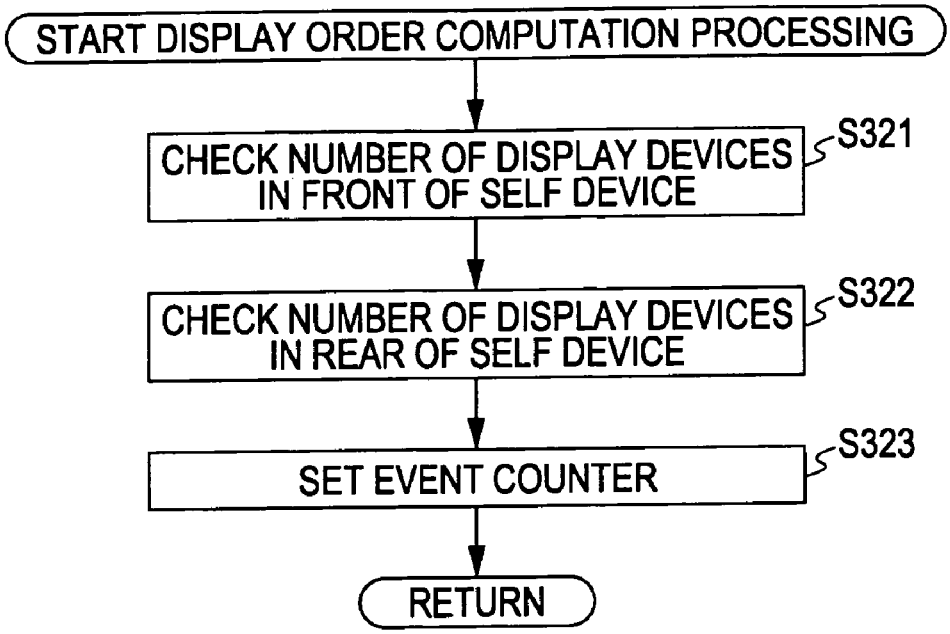
FIG. 32 is a flowchart illustrating an example of display order computation processing.

In step S303, each processing section executes the display order computation processing that will be described later with reference to FIG. 32. Now, referring to the flowchart of FIG. 32, the display order computation processing in step S303 of FIG. 31 will be described in detail.

In step S321, each processing section checks the number of display devices located in front of the self device. When, for example, the overall configuration table confirmed in the processing of step S301 is the overall configuration table shown in FIG. 12, and its own ID confirmed in the processing of step S302 is "A3", the strobe processing section 222 (when the strobe processing is being executed) confirms that the number of display devices located in front of the self device is one, namely the display device corresponding to the position A1. That is, since the display device corresponding to the position A2 has been detached and no image can be displayed at the position, it follows that there is one display device that is located in front of the self device. Since the normal image continues to be displayed on the display device corresponding to the position A1 in the information extraction processing or the memo processing, the information extraction processing section 223 or the memo processing section 224 confirms that the number of display devices located in front of the self device is zero.

In step S322, each processing section checks the number of display devices located in rear of the self device. In the present case, each processing section confirms the number of display devices located in rear of the self device to be two, namely the display devices respectively corresponding to the position C2 and C3. That is, since the display devices corresponding to the positions B1 to B3 face the back and cannot be used for image display according to this processing, and the display device corresponding to the position C1 has been detached, it follows that there are two display devices located in rear of the self device.

In step S323, each processing section sets an event counter on the basis of the results of processing in step S321 and S322. For example, the strobe processing section 222 confirms that the self device corresponds to the second display device from among the total of four display devices that can display stilled images, and sets the event counter accordingly. As a result, for example, the event counter is set so that the image of the second frame, the image of the sixth (2+4) frame, and so on are displayed.

Further, the information extraction processing section 223 or the memo processing section 224 confirms that the self device corresponds to the first display device from among the total of three display devices that can display stilled images, and sets the event counter accordingly. As a result, for example, the event counter is set so that the information extraction result 1 or memo 1, information extraction result 4 (1+3) or memo 4, and so on are displayed.

Returning to FIG. 31, after the processing of step S303, the processing advances to step S304 where each processing section determines whether or not the time-specific individual display processing has been finished. When, for example, the end of processing has been commanded by the user using a remote control, in step S303, the processing is determined to have been finished.

When it is determined in step S304 that the processing has not been finished, the processing advances to step S305 where each processing section determines whether or not an event has been detected, and waits on standby until it is determined that the event has been detected. Here, an event serves as a trigger for stilling an image. For example, when the strobe processing is being executed, the elapse of a predetermined period of time (for example, a period of time corresponding to one frame) is regarded as the event. Further, when the information extraction processing is being executed, the detection of a specific image such as a telop is regarded as the event, and when the memo processing is being executed, the execution of the still processing by the user is regarded as the event.

When it is determined in step S305 that the event has been detected, the processing advances to step S306 where each processing section increments the event counter set through the processing described above with reference to FIG. 32.

In step S307, each processing section determines whether or not it is the turn of the self device to display the image. In the present case, for example, the strobe processing section 222 determines that it is the turn of the self device to display the image when the events corresponding to the image of the second frame, the image of the sixth (2+4) frame, and so on have been detected. The information extraction processing section 223 or the memo processing section 224 determines that it is the turn of the self device to display the image when the events corresponding to the information extraction result 1 or memo 1, the information extraction result 4 (1+3) or memo 4, and so on have been detected.

In step S308, each processing section stills the image and displays the resultant still image.

Thereafter, the processing returns to step S304. The subsequent processing is repeatedly executed until it is determined in step S304 that the time-specific individual display processing has been finished.

In this way, the time-specific individual display processing (that is, the strobe processing, the information extraction processing, or the memo processing) is executed. With such processing being executed by each of the display devices mounted to the scalable television system 100, image display can be performed in an appropriate manner even when the configuration of the scalable television system 100 changes.

Next, description will be given of multi-view processing executed by the multi-view processing section 225 that is one of the modules included in the application processing section 205 shown in FIG. 9. The multi-view processing refers to processing whereby a plurality of kinds of images are displayed using a plurality of display devices. The multi-view processing allows, for example, the movements of players at respective positions to be shown in an easy to follow manner during the broadcasting of a baseball game. The multi-view processing is executed on the basis of, for example, a command from the user.

Figure 33:
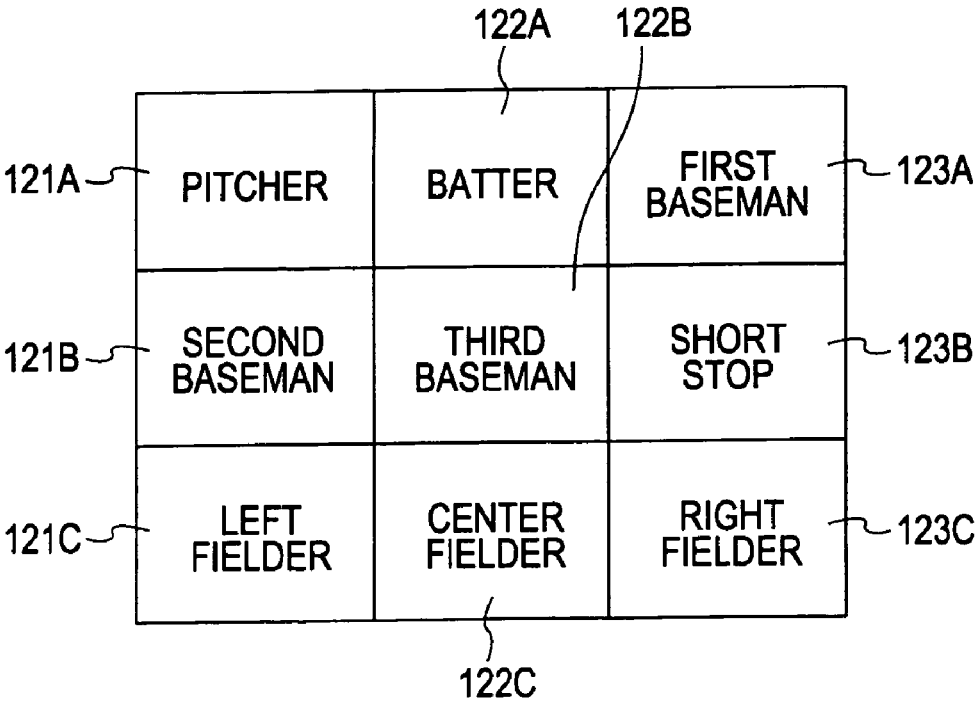
FIG. 33 is a diagram showing an example of an image displayed by multi-view processing.

FIG. 33 is a diagram showing an example of image display when the multi-view processing is executed in the state where none of the units 101-1 to 101-3 has been rotated in the scalable television system 100. In the example of the drawing, images corresponding to respective preset positions are displayed sequentially on the respective display devices.

As shown in the drawing, images corresponding to respective positions are displayed sequentially in such a manner that the image of the pitcher is displayed on the display device 121A, the image of the batter is displayed on the display device 122A, the image of the first baseman is displayed on the display device 123A, and so on.

Figure 34:
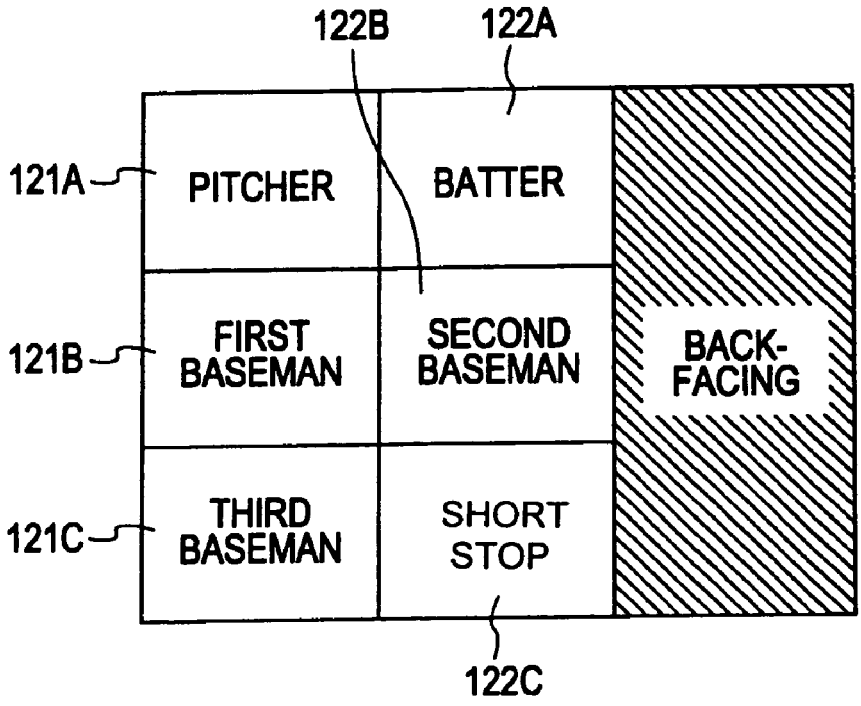
FIG. 34 is a diagram showing another example of an image displayed by multi-view processing.

FIG. 34 is a diagram showing an example of image display when the multi-view processing is executed in the state where the unit 101-1 has been rotated in the scalable television system 100. In FIG. 34, unlike in the case of FIG. 33, the display devices 123A to 123C face the back and thus cannot display images due to multi-view processing. Accordingly, images corresponding to respective positions are sequentially displayed in such a manner that the image of the pitcher is displayed on the display device 121A, the image of the batter is displayed on the display device 122B, the image of the first baseman is displayed on the display device 121B, and so on. Images of the left fielder, right fielder, and center stop are not displayed. At this time, the determination as to the image of which position is to be displayed and the image of which position is not to be displayed is controlled on the basis of, for example, a table indicating the priority order of display for the images of the respective preset positions.

Note that in the scalable television system, when a unit(s) other than the unit 101-3 has been rotated, or when the multi-view processing is executed in the state where a display device(s) has been detached from a unit(s), the image display is controlled in the same manner as in FIGS. 24 to 26.

Figure 35:
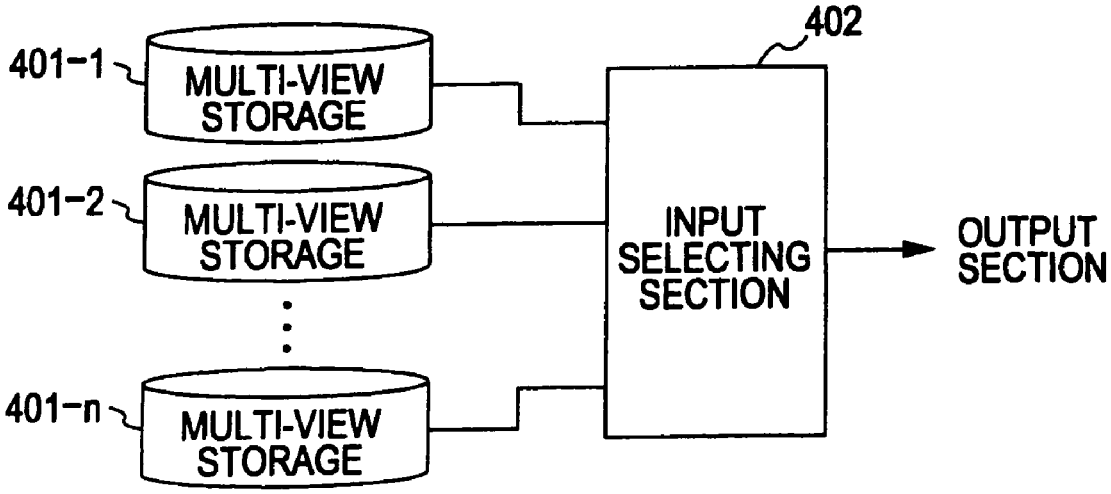
FIG. 35 is a block diagram showing in detail an example of the configuration of a multi-view processing section.

FIG. 35 is a block diagram showing in detail an example of the configuration of the multi-view processing section 225. In this example, there are provided multi-view storages 401-1 to **401-*n* that store a plurality of kinds of images displayed in the form of a multi-view. For example, the images of the respective positions that have been multiplexed onto a broadcast signal are split into individual images and stored in different multi-view storages. Then, by means of an input selecting section 402**, the multi-view storage storing an image to be displayed is selected on the basis of, for example, a command from the user, and output to an output section.

Note that the plurality of kinds of images are not limited to those stored in the multi-view storages. For example, a plurality of kinds of images may be supplied from a multi-view tuner that receives signals from a plurality of channels to generate images (sounds).

Figure 36:
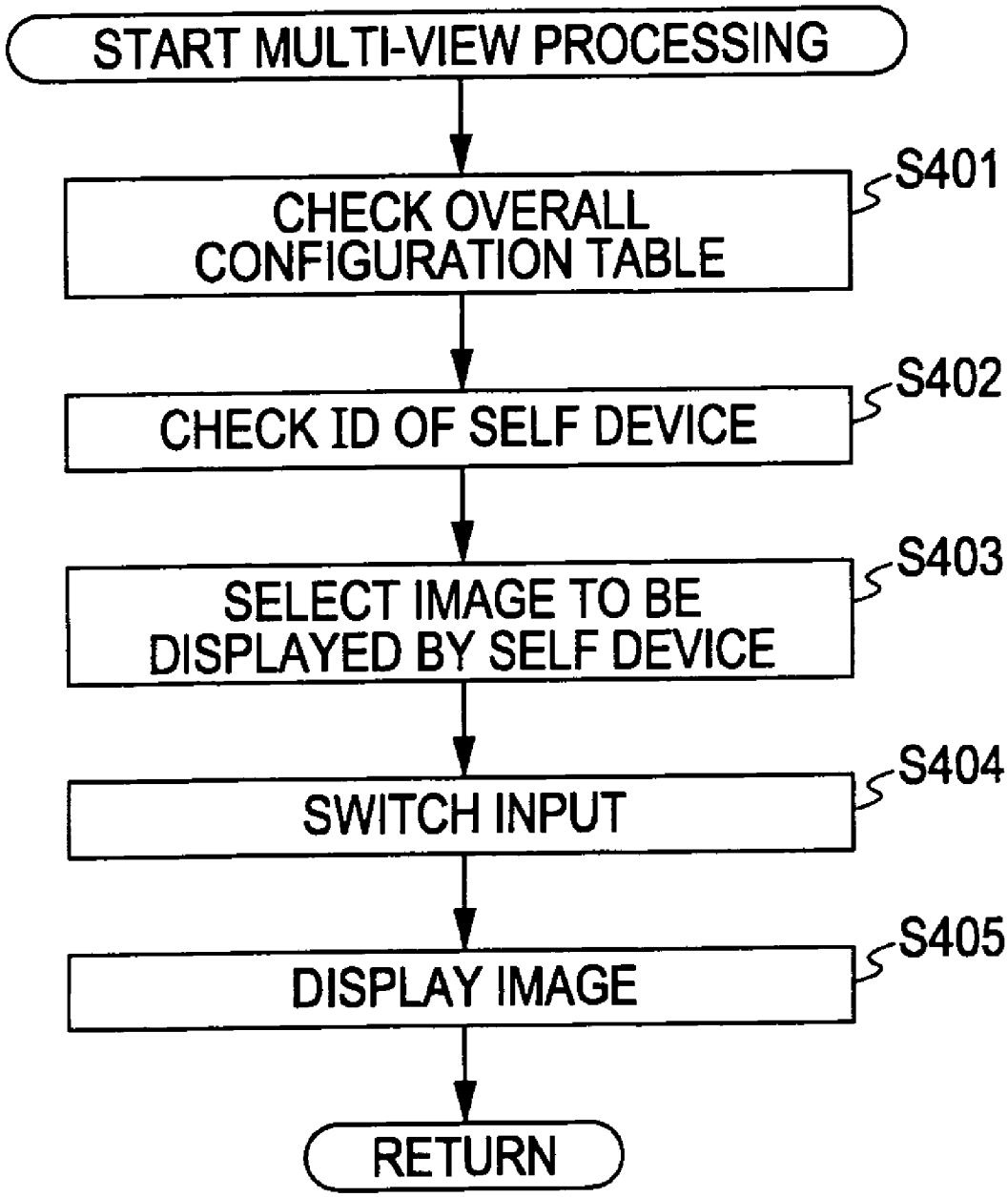
FIG. 36 is a flowchart illustrating multi-view processing.

Next, referring to the flowchart of FIG. 36, detailed description will be given of the multi-view processing that is one kind of the individual application processing in step S102, S105, or S107 of FIG. 10. This processing is executed in step S102, S105, or S107 when, in the application processing section 205, the multi-view processing section 225 is being selected as the module to execute processing.

In step S401, the multi-view processing section 225 acquires via the central processing section 202 the overall configuration table stored in the table storage section 203, and checks the contents thereof.

In step S402, the multi-view processing section 225 checks the ID of the self device. That is, the multi-view processing section 225 checks to which of the display devices mounted at the positions A1 to C3 the self device corresponds.

In step S403, the multi-view processing section 225 selects the image to be displayed by the self device. Accordingly, for example, one multi-view storage is selected from among the multi-view storages 401-1 to **401-*n***.

In step S404, the multi-view processing section 225 outputs the image selected by the processing of step S403 to the output section. In step S405, the image output by the processing of step S404 is displayed.

The multi-view processing is performed in this manner. As a result, the image to be displayed (image having a high priority) can be displayed even when the configuration of the scalable television system 100 changes.

Next, description will be given of interrupt processing executed by the security interrupt processing section 226 that is one of the modules included in the application processing section 205 shown in FIG. 9. The interrupt processing refers to processing whereby when there is a call on the interphone, for example, the image of a monitor connected to the interphone is forcibly displayed (interrupt-displayed) on a part of the scalable television system 100. A1ternatively, warning on disaster prevention, crime prevention, or the like can be displayed in the form of interrupt display.

Figure 37:
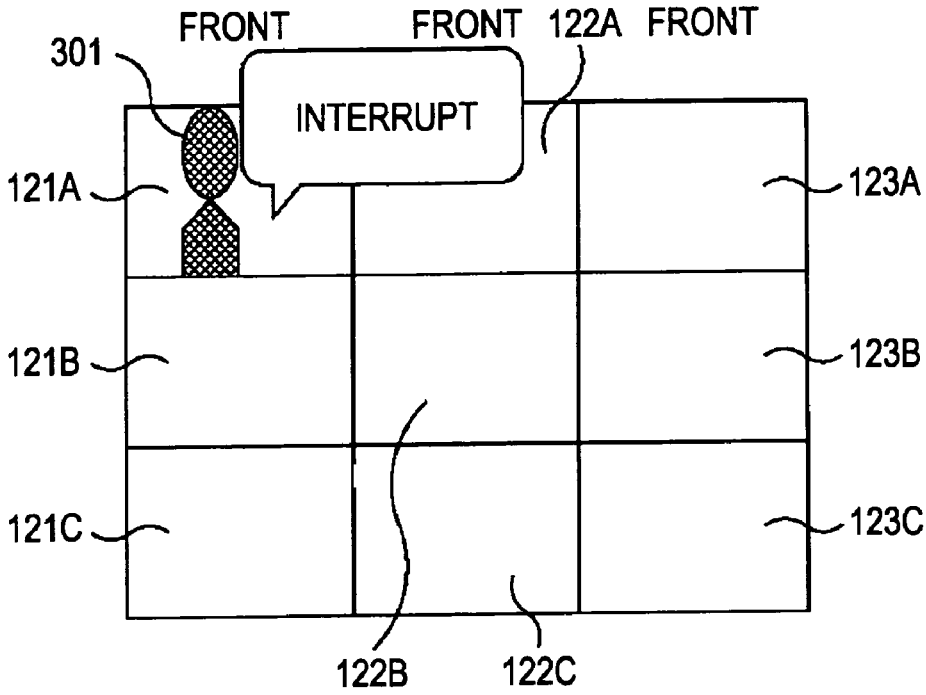
FIG. 37 is a diagram showing an example of an image displayed by interrupt processing.

FIG. 37 is a diagram showing an example of interrupt processing in the state where none of the units 101-1 to 101-3 has been rotated (all of the display devices are facing the front) in the scalable television system 100. In this state, of the nine display devices 121A to 123C, an image is interrupt-displayed on the display device 121A corresponding to the most upper left position A1. At this time, the display devices other than the display device 121A continue to display the images that have been displayed. For example, when the zoom processing is being executed, the eight display devices 121B to 123C continue to display images corresponding to respective portions of the image to be displayed at the magnification of 9.

Figure 38:
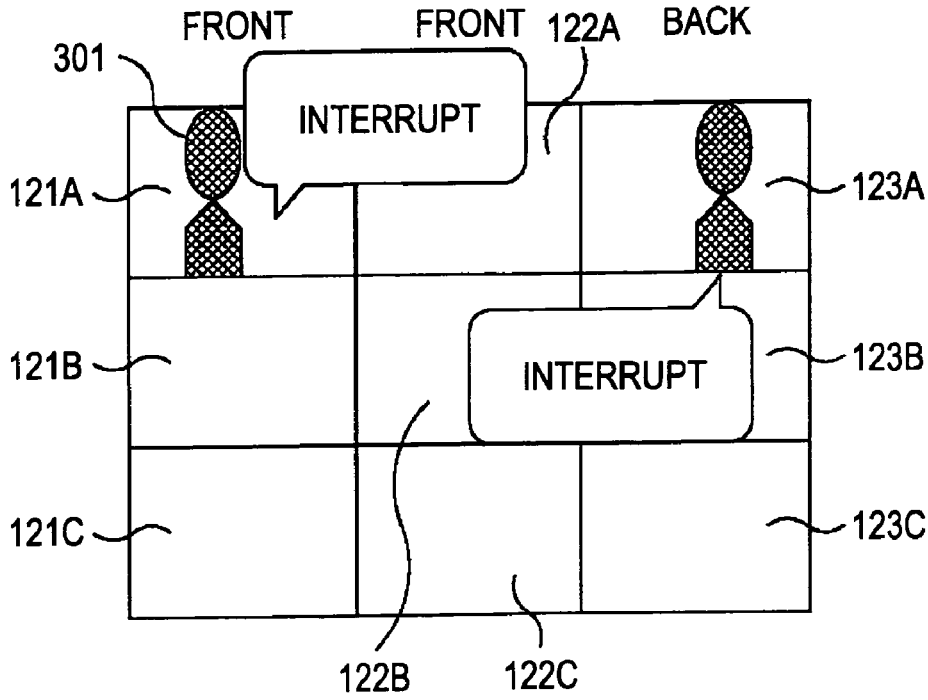
FIG. 38 is a diagram showing another example of an image displayed by interrupt processing.

FIG. 38 is a diagram showing an example of interrupt processing in the state where the unit 101-3 has been rotated by 180°. In this state, of the six display devices 121A to 122C facing the front, an image is interrupt-displayed on the most upper left display device 121A. Further, of the display devices 123A to 123C facing the back, an image is interrupt-displayed on the most upper left (uppermost) display device 123A.

Note that in the drawing, for the sake of convenience, the back-facing display devices 123A to 123C mounted to the unit 101-3 are depicted as facing the front. In actuality, however, the display sections of the display devices 123A to 123C face the side opposite to the display sections of the display devices 121A to 122C (the side opposite to the plane of the drawing). Accordingly, the images displayed by the back-facing display devices 123A to 123C, including the image to be interrupt-displayed on the display device 123A, are not observed by the user viewing and listening to the scalable television system 100 from the front side.

That is, in the scalable television system 100, when, for example, there is a call on the interphone, one of the front-facing display devices, and one of the back-facing display devices are each forcibly switched to display the image of the monitor connected to the interphone, thereby allowing interrupt-display of an image. Note that the front-facing display devices other than the display device 121A, and the back-facing display devices other than the display device 123A each continue to display the image that has been displayed. With this arrangement, information to be urgently notified can be presented to both the user viewing the scalable television system 100 from the front side and the user viewing the scalable television system 100 from the back side.

Note that in the security interrupt processing, the display device on which an image is to be interrupt-displayed is not limited to the one upper left display device but may be set in an arbitrary manner.

Figure 39:
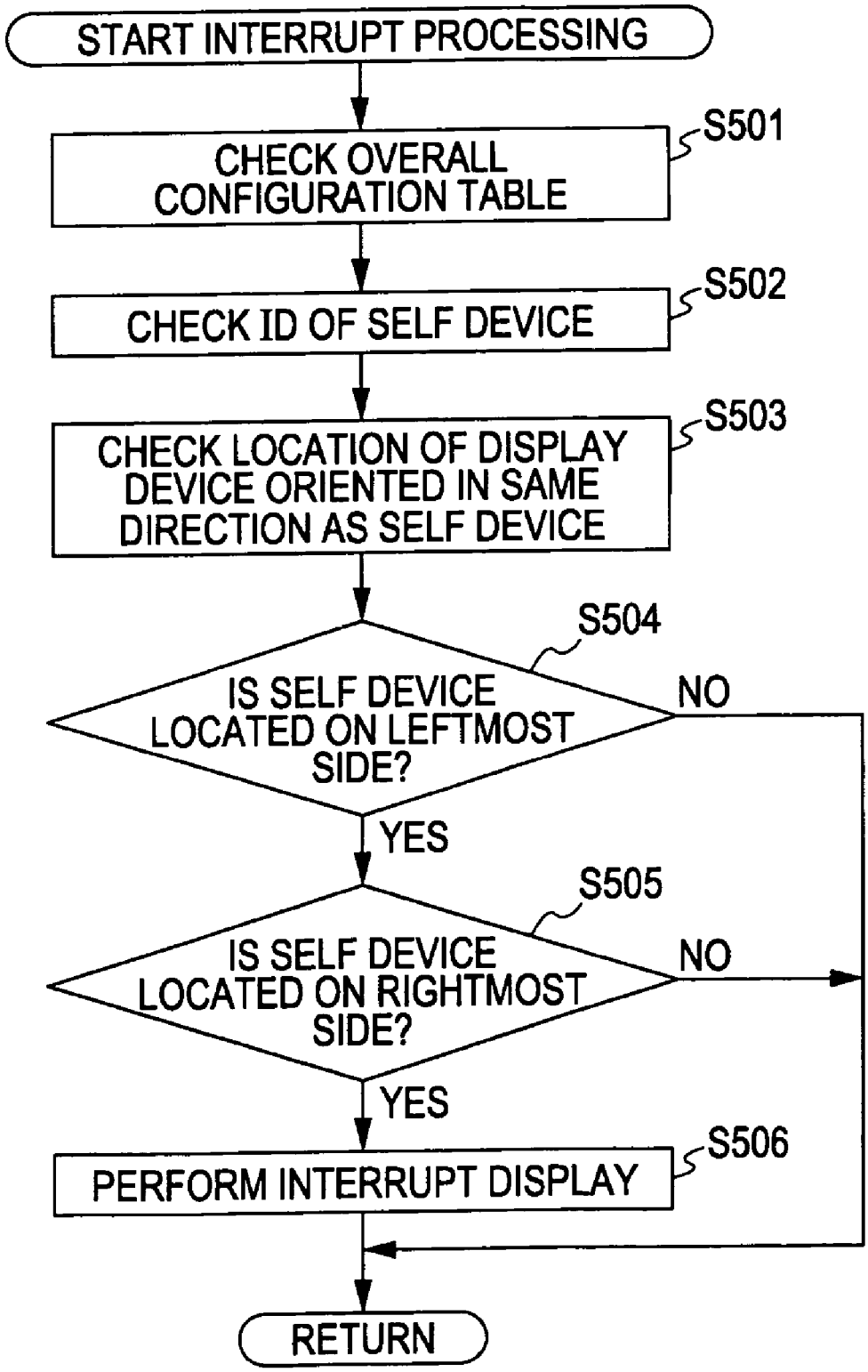
FIG. 39 is a flowchart illustrating an example of interrupt processing.

Next, referring to the flowchart of FIG. 39, the interrupt processing in step S109 of FIG. 10 will be described in detail.

In step S501, the security interrupt processing section 226 acquires via the central processing section 202 the overall configuration table stored in the table storage section 203, and checks the contents thereof.

In step S502, the security interrupt processing section 226 checks the ID of the self device. That is, the security interrupt processing section 226 checks to which of the display devices mounted at the positions A1 to C3 the self device corresponds.

In step S503, the security interrupt processing section 226 checks the locations of display devices that face the same direction as the self device on the basis of the results of processing in steps S501 and S502.

In step S504, on the basis of the results of processing in step S503, the security interrupt processing section 226 determines whether or not, of the display devices facing the same direction as the self device, the self device is located at the leftmost position. When it is determined that the self device is located on the leftmost side, the processing advances to step S505.

In step S505, on the basis of the results of processing in step S503, the security interrupt processing section 226 determines whether or not, of the display devices facing the same direction as the self device, the self device is located at the uppermost position. When it is determined that the self device is the uppermost one, the processing advances to step S506.

In step S506, the security interrupt processing section 226 interrupts the image that has been displayed, and displays instead the image of a monitor connected to the interphone or the like, for example.

On the other hand, when it is determined in step S504 that the self device is not located at the uppermost position from among the display devices facing the same direction as the self device, or when it is determined in step S505 that the self device is not located at the uppermost position from among the display devices facing the same direction as the self device, the processing of step S506 is skipped, so the image that has been displayed continues to be displayed.

The interrupt processing is performed in this way. Accordingly, even when the configuration of the scalable television system 100 changes, information to be urgently notified can be promptly presented to both the user viewing the scalable television system 100 from the front side and the user viewing the scalable television system 100 from the back side.

While the foregoing description is directed to the case in which the scalable television system 100 includes three units, the scalable television system 100 may include four units or more, or two units or less.

Further, while the foregoing description is directed to the case in which three display devices can be mounted to one unit, the number of display devices that can be mounted to one unit is not limited to three.

Further, while the foregoing description is directed to the case in which a plurality of display deices are mounted in a vertical row to one vertically elongated unit, and a plurality of such vertically elongated units are connected together while being arranged side by side in the horizontal direction, an arrangement is also possible in which a plurality of display devices are mounted in a horizontal row to one horizontally elongated unit, and a plurality of such horizontally elongated units are connected together while being arranged side by side in the vertical direction.

Note that the series of processing described above can be executed by either of hardware and software. In the case where the series of processing described above is to be executed by software, the program constituting the software is installed from the network or recording medium to a computer incorporated in dedicated hardware, or a general-purpose personal computer 500 such as one shown in FIG. 40 that is capable of executing various functions by installing various programs.

Figure 40:
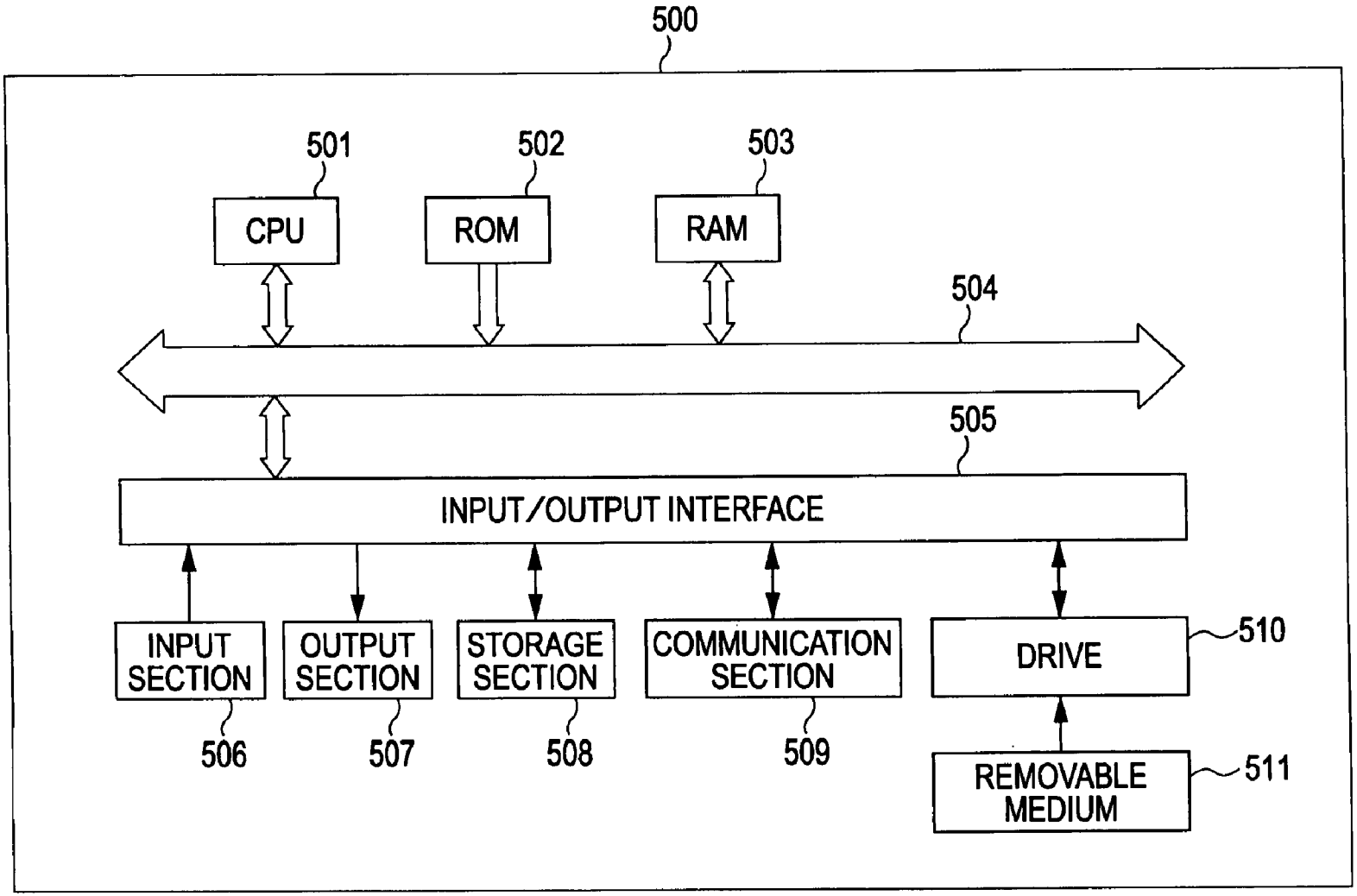
FIG. 40 is a block diagram showing an example of configuration of a personal computer.

In FIG. 40, a CPU (Central Processing Unit) 501 executes various processing in accordance with a program stored in an ROM (Read Only Memory) 502 or a program loaded to an RAM (Random Access Memory) 503 from a storage section 508. Data necessary for the CPU 501 in executing various processing, and the like are also stored in the RAM 503 as appropriate.

The CPU 501, the ROM 502, and the RAM 503 are connected with each other via a bus 504. An input/output interface 505 is also connected to the bus 504.

An input section 506, an output section 507, the storage section 508, and a communication section 509 are connected to the input/output interface 505. The input section 506 includes a keyboard, a mouse or the like. The output section 507 includes a display, including a CRT (Cathode Ray Tube), an LCD (Liquid Crystal Display), or the like, and a speaker or the like. The storage section 508 includes a hard disk or the like. The communication section 509 includes a modem, a network interface card such as a LAN card, or the like. The communication section 509 performs communication processing via a network including the Internet.

A drive 510 is also connected to the input/output interface 505 as required. A removable medium 511 such as a magnetic disk, an optical disk, a magneto-optical disk, or a semiconductor memory is loaded as appropriate, and a computer program read from the removable medium 511 is installed to the storage section 508 as required.

When the series of processing described above is to be executed by software, the program constituting the software is installed from the network such as the Internet or from a recording medium including the removable medium 51 or the like.

Note that examples of the recording medium include not only those constituted by the removable medium 511 such as a magnetic disk (including a floppy disk (registered trademark)), an optical disk (including a CD-ROM (Compact Disk-Read Only Memory) and DVD (Digital Versatile Disk)), a magneto-optical disk (including an MD (Mini-Disk) (registered trademark)), or a semiconductor memory shown in FIG. 40 in which programs are recorded, which are separate from the apparatus main body and distributed to the user to deliver the programs, but also those constituted by a hard disk included in the ROM 502, in which programs are recorded, or the storage section 508, which are distributed to the user while being previously incorporated into the apparatus main body.

The steps for executing the series of processing described above in this specification include, in addition to those processing performed on a time-series basis in accordance with the described order, those processing that are not necessarily performed on a time-series basis but are executed in a parallel or individual manner.

According to the embodiment of the present invention, in applications where a number of display devices such as television receivers are connected with each other for use, the user's convenience can be improved.

It should be understood by those skilled in the art that various modifications, combinations, sub-combinations and alterations may occur depending on design requirements and other factors insofar as they are within the scope of the appended claims or the equivalents thereof.

What is claimed is:

1. An interconnection unit for a composite image display apparatus that displays an image by a plurality of display devices that are detachably mounted to a plurality of mounting positions on a plurality of interconnection units, each interconnection unit comprising:

the mounting positions on which the plurality of display devices are detachably mounted, the plurality of interconnection units connected to each other;

self-state acquiring means for acquiring identification information of a display device indicating a mounting position of the display device and a mounting state of the display device mounted on the interconnection unit including the self-state acquiring means;

other-device-state acquiring means for acquiring identification information indicating a mounting position of each of the plurality of display devices and a mounting state of each of the plurality of display devices mounted on another one of the plurality of interconnection units with respect to the interconnection unit including the other-device-state acquiring means; and display controlling means for controlling display of an image to be displayed on the display device, mounted on the interconnection unit including the display controlling means, on the basis of information acquired by each of the self-state acquiring means and the other-device-state acquiring means, wherein when the image is a moving image, the display controlling means includes still timing selecting means for selecting a timing for stilling the moving image displayed on the display device on the basis of the connection among the plurality of interconnection units and mounting positions of the plurality of display devices mounted on the another one of the plurality of interconnection units that are oriented in the same direction as the display device.

2. The interconnection unit according to claim 1, wherein each of the plurality of display devices mounted on the plurality of interconnection units can be oriented to face one of two directions different from each other by 180° while being mounted on the composite image display apparatus.

3. The interconnection unit according to claim 2, wherein the identification information indicating the mounting state acquired by the self-state acquiring means or the information acquired by other-device-state acquiring means is information indicating whether the display device, mounted on the interconnection unit including the self-state acquiring means, or each of the other display devices, mounted on another one of the plurality of interconnection units with respect to the interconnection unit including the other-device-state acquiring means, is currently mounted at a predetermined position, and an orientation of the display section.

4. The interconnection unit according to claim 3, wherein on the basis of the information acquired by each of the self-state acquiring means and the other-device-state acquiring means, each display device displays an image that is the same as images displayed on the plurality of display devices, mounted on the another one of the plurality of interconnection units, that are oriented in the same direction as the display device.

5. The interconnection unit according to claim 1, wherein the display controlling means includes area/magnification selecting means for selecting an area of the image to be displayed by the display device mounted on the interconnection unit including the display controlling means, and a display magnification for an image corresponding to the area, on the basis of the connection among the plurality of interconnection units and mounting positions of the plurality of display devices mounted on the another one of the plurality of interconnection units that are oriented in the same direction as the display device mounted on the interconnection unit including the display controlling means.

6. The interconnection unit according to claim 1, wherein the preset event occurs each time a predetermined period of time elapses.

7. The interconnection unit according to claim 1, wherein the preset event occurs when display of a specific preset image is detected.

8. The interconnection unit according to claim 1, wherein the preset event occurs upon command from a user.

9. The interconnection unit according to claim 1, wherein the display controlling means includes image kind selecting means for selecting, from among a plurality of kinds of images, an image to be displayed by the display device on the basis of the connection among the plurality of interconnection units and mounting positions of the plurality of display devices mounted on the another one of the plurality of interconnection units that are oriented in the same direction as the display device.

10. The interconnection unit according to claim 1, wherein the display controlling means includes image switching means for forcibly switching the image displayed on the display device on the basis of the connection among the plurality of interconnection units and mounting positions of the plurality of display devices mounted on the another one of the plurality of interconnection units that are oriented in the same direction as the display device and on the basis of a signal transmitted from external equipment connected to the composite image display apparatus.

11. A composite image display apparatus comprising a plurality of the display devices according to any one of claims 1, 2, 3, 4, 5, 6, 7, 8, 9 or 10 that are mounted at a plurality of mounting positions on a plurality of interconnection means, the composite image display apparatus displaying an image by the plurality of the display devices.

12. A display method for an interconnection unit for a composite image display apparatus that displays an image by a plurality of display devices that are detachably mounted to a plurality of mounting positions on a plurality of interconnection units, the display method comprising:

connecting the plurality of interconnection units to each other;

mounting the plurality of display devices detachably on the plurality of interconnection units;

acquiring self-state identification information of a display device indicating a mounting position of the display device and a mounting state of the display device mounted on the interconnection unit acquiring the self-state identification information;

acquiring other-device-state information indicating a mounting position of each of the plurality of display devices and a mounting state of each of the plurality of display devices mounted on another one of the plurality of interconnection units with respect to the interconnection unit acquiring the other-device-state information; and controlling display of an image to be displayed on the display device, mounted on the interconnection unit controlling the display, on the basis of information acquired in the acquiring self-state information and the acquiring other-device-state information, wherein when the image is a moving image, the controlling the display includes selecting a timing for stilling the moving image displayed on the display device on the basis of the connection among the plurality of interconnection units and mounting positions of the plurality of display devices mounted on another one of the plurality of interconnection units that are oriented in the same direction as the display device.

13. A non-transitory computer-readable storage medium having embedded therein instructions, which when executed by a processor, cause the processor to execute a method for causing display processing by an interconnection unit for a composite image display apparatus that displays an image by a plurality of display devices that are detachably mounted to a plurality of mounting positions on a plurality of interconnection units, the method comprising:

connecting the plurality of interconnection units to each other;

mounting the plurality of display devices detachably on the plurality of interconnection units;

controlling acquisition of self-state identification information of a display device indicating a mounting position of the display device and a mounting state of the display device mounted on the interconnection unit acquiring the self-state identification information;

controlling acquisition of other-device-state information indicating a mounting position of each of the plurality of display devices and a mounting state of each of the plurality of display devices mounted on another one of the plurality of interconnection units with respect to the interconnection unit acquiring the other-device-state information; and controlling display of an image to be displayed on the display device, mounted on the interconnection unit controlling the display, on the basis of the information acquired in the controlling acquisition of self-state information and the controlling acquisition of other-device-state information, wherein when the image is a moving image, the controlling the display includes selecting a timing for stilling the moving image displayed on the display device on the basis of the connection among the plurality of interconnection units and mounting positions of the plurality of display devices mounted on another one of the plurality of interconnection units that are oriented in the same direction as the display device.

14. An interconnection unit for a composite image display apparatus that displays an image by a plurality of display devices that are detachably mounted to a plurality of mounting positions on a plurality of interconnection units, each of the interconnection units comprising:

the mounting positions on which the plurality of display devices are detachably mounted, the plurality of interconnection units being connected to each other;

a self-state acquiring unit configured to acquire identification information of a display device indicating a mounting position of the display device and a mounting state of the display device mounted on the interconnection unit including the self-state acquiring unit;

an other-device-state acquiring unit configured to acquire identification information indicating a mounting position of each of the plurality of display devices and a mounting state of each of the plurality of display devices mounted on another one of the plurality of interconnection units with respect to the interconnection unit including the other-device-state acquiring unit; and a display controlling unit configured to control display of an image to be displayed on the display device, mounted on the interconnection unit including the display controlling unit, on the basis of information acquired by each of the self-state acquiring unit and the other-device-state acquiring unit, wherein when the image is a moving image, the display controlling unit includes a still timing selecting unit to select a timing for stilling the moving image displayed on the display device on the basis of the connection among the plurality of interconnection units and mounting positions of the plurality of display devices mounted on the another one of the plurality of interconnection units that are oriented in the same direction as the display device.

15. The interconnection unit according to claim 14, wherein the preset event occurs each time a predetermined period of time elapses.

16. The interconnection unit according to claim 14, wherein the preset event occurs when display of a specific preset image is detected.

17. The interconnection unit according to claim 14, wherein the preset event occurs upon command from a user.

18. An apparatus for displaying an image from a plurality of display devices that are detachably mounted at a plurality of mounting positions on a plurality of interconnection units, the apparatus comprising:

a plurality of interconnection units connected to each other, the plurality of interconnection units having the mounting positions on which the plurality of display devices are detachably mounted, and each of the plurality of interconnection means including, a first acquiring unit configured to acquire identification information of a first device indicating a mounting position of the first device and a mounting state of the first device mounted on the interconnection unit including the first acquiring unit;

a second acquiring unit configured to acquire identification information indicating a mounting position of each of the plurality of display devices and a mounting state of each of the plurality of display devices mounted on another one of the plurality of interconnection units with respect to the interconnection unit including the second acquiring unit; and a display controlling unit configured to control display of an image to be displayed on the display device, mounted on the interconnection unit including the display controlling unit, on the basis of information acquired by the first acquiring unit and the second acquiring unit, wherein when the image is a moving image, the display controlling unit includes a still timing selecting unit to select a timing for stilling the moving image displayed on the display device on the basis of the connection among the plurality of interconnection units and mounting positions of the plurality of display devices mounted on the another one of the plurality of interconnection units that are oriented in the same direction as the display device.

* * * * *